US010888921B2

(12) United States Patent
Chen et al.

(10) Patent No.: US 10,888,921 B2
(45) Date of Patent: Jan. 12, 2021

(54) MULTI-POSITION PARALLEL PRESSURIZED CASTING DEVICE AND METHOD FOR LARGE ALUMINUM ALLOY CASTINGS

(71) Applicant: No.59 Research Institute of China Ordnance Industry, Chongqing (CN)

(72) Inventors: Qiang Chen, Chongqing (CN); Zhiwei Huang, Chongqing (CN); Zude Zhao, Chongqing (CN); Gaozhan Zhao, Chongqing (CN); Jianquan Tao, Chongqing (CN); Yuanyuan Wan, Chongqing (CN); Ming Li, Chongqing (CN); Zhihui Xing, Chongqing (CN)

(73) Assignee: NO.59 RESEARCH INSTITUTE OF CHINA ORDNANCE INDUSTRY, Chongqing (CN)

( * ) Notice: Subject to any disclaimer, the term of this patent is extended or adjusted under 35 U.S.C. 154(b) by 0 days.

(21) Appl. No.: 16/505,713

(22) Filed: Jul. 9, 2019

(65) Prior Publication Data

US 2020/0038947 A1 Feb. 6, 2020

(30) Foreign Application Priority Data

Aug. 1, 2018 (CN) ..... 2018 1 0865364

(51) Int. Cl.

| | |
|---|---|
| ***B22D 18/02*** | (2006.01) |
| ***B22D 18/08*** | (2006.01) |
| ***B22D 45/00*** | (2006.01) |

(52) U.S. Cl.

CPC ..... *B22D 18/02* (2013.01); *B22D 18/08* (2013.01); *B22D 45/00* (2013.01)

(58) Field of Classification Search

CPC ..... B22D 18/02; B22D 18/04; B22D 18/08; B22D 45/00

See application file for complete search history.

(56) References Cited

U.S. PATENT DOCUMENTS

| | | | | |
|---|---|---|---|---|
| 5,042,561 A * | 8/1991 | Chandley | ..... | B22D 18/04 164/119 |
| 5,791,398 A * | 8/1998 | Ono | ..... | B22D 18/04 164/306 |
| 2014/0047952 A1* | 2/2014 | Zeng | ..... | C22B 9/10 75/678 |

FOREIGN PATENT DOCUMENTS

CN 104874767 B 9/2015

* cited by examiner

*Primary Examiner* — Kevin P Kerns
*Assistant Examiner* — Steven S Ha
(74) *Attorney, Agent, or Firm* — Bayramoglu Law Offices LLC

(57) ABSTRACT

A multi-position parallel pressurized casting device for large aluminum alloy castings and method thereof are provided. The device includes a platform, a top surface of the platform is a working surface, and a bottom of the platform is provided with a holding furnace. A number of the holding furnace is two or more, and each holding furnace is connected to a liquid filling port corresponding to the working surface by a separate lift device, and the holding furnaces can achieve independent liquid level pressure control or synchronization liquid level pressure control in any combination by a lift control system; and a cover body is also provided on the working surface, the cover body and the working surface form a sealed working chamber. A vacuum-pumping system and an inert gas replacement system for the working chamber and/or the holding furnace are further provided.

17 Claims, 7 Drawing Sheets

MULTI-POSITION PARALLEL PRESSURIZED CASTING DEVICE AND METHOD FOR LARGE ALUMINUM ALLOY CASTINGS

CROSS REFERENCE TO THE RELATED APPLICATIONS

This application is based upon and claims priority to Chinese Patent Application No. 201810865364.4, filed on Aug. 1, 2018, the entire contents of which are incorporated herein by reference.

TECHNICAL FIELD

The present invention relates to a casting device and a method for an aluminum alloy casting, in particular to a device and a method for a precision casting of a large aluminum alloy piece.

BACKGROUND

The demand and application of large and complex castings, especially large and complex aluminum alloy frames, plate shapes and cabin castings, are becoming more wider and wider in the fields of aerospace, weapons, ships, automobiles, electronics. This kind of castings has structural characteristics of large overall dimension (a maximum value of the overall dimension is about 2500 mm), variable wall thickness (5 mm-100 mm), long process, scattered hot spots, etc. These structural characteristics lead to many problems in the casting process: first, a high differential pressure on the casting wall thickness, and an unstable liquid lifting and an out-of-sync liquid level are prone to generate turbulence and air entrapment; second, the long process, and a large surface tension of a melt may cause a large area of cold shut and misrun to the castings; third, the casting has multiple dispersive hot spots, and the casting process has insufficient feeding ability, resulting in excessive pinholes and porosity; fourth, a temperature difference between a solid region and a liquid region of a paste-like solidified alloy is large, resulting in a serious hot cracking tendency; fifth, Al—Mg alloy castings are subjected to a mold filling under an atmosphere, causing serious oxidation and burning of Mg elements. The above problems frequently appear in the development and production process of castings, restricting the application of large aluminum alloy castings in weapons and equipment. At present, research on large aluminum alloy casting technology and equipment have been carried out in China, and some precision casting technologies, such as vacuum pressurized casting, low pressure casting, differential pressure casting, etc., have been applied in aviation, aerospace, weapons and other fields. However, the yield of castings is low.

A multi-tube low pressure/differential pressure casting process and device thereof are disclosed in the Chinese patent CN104874767B. Specifically, a casting table, a mold disposed on the casting table, at least one casting furnace disposed under the casting table, a heating device disposed in the casting furnace, and an airtight gland disposed between the casting furnace and the casting table are disclosed. The airtight gland is provided with an air inlet, the casting table is provided with at least two sprue gates, the mold is provided with a liquid inlet corresponding to any of the at least two sprue gates, and each of the sprue gates is respectively provided with a lift tube extending downward into at least one casting furnace. In the patent, the low pressure/differential pressure casting process and equipment with simultaneous liquid lifting by multiple tubes are used, so that there is a better solution in the design process. The design of pouring gate shortens the flow distance of the liquid alloy, and reduces the heat loss, effectively solving the problem of misrun under the premise of not increasing pouring temperature.

However, the above patent also has the following problems: the melt after the mold filling gets easily oxidized under atmospheric conditions; it is inconvenient to take the mold after casting, and the lift tube gets easily freezed; the control precision of liquid level pressure is low, and the melt fluctuates greatly in the mold cavity during the mold filling. Theses problems greatly affect the internal quality of castings, especially for large (over 1500 kg, and a maximum outer dimension of about 2500 mm), variable wall thickness (5 mm-100 mm), and complex abnormal shape castings.

SUMMARY

The objective of the present invention is to provide a multi-position parallel pressurized casting device for large aluminum alloy castings capable of improving an internal quality of a casting.

In order to achieve the above objective, the present invention is realized as follows. A multi-position parallel pressurized casting device for large aluminum alloy castings includes a platform, wherein a top surface of the platform is a working surface, and a bottom of the platform is provided with holding furnaces. The number of holding furnaces is two or more, each holding furnace is connected to a liquid filling port corresponding to the working surface through a separate lift device, and the holding furnace can realize an independent liquid level pressure control or a synchronous liquid level pressure control in any combination by a lift control system. A cover body is further provided on the working surface, the cover body and the working surface form a sealed working chamber. A vacuum-pumping system and an inert gas replacement system are further provided for the working chamber and/or the holding furnace.

Adopting the above-mentioned arrangements, the multi-position parallel pressurized casting can be achieved, which is suitable for manufacturing large and complex castings, especially large and complex aluminum alloy frames, plate shapes, cabins and the like, in the fields of aerospace, weapons, ships, automobiles, electronics, etc., solving the problems of turbulence, cold shut, misrun, excessive pinholes and porosity, and oxidized inclusions serious in the existing manufacture process of these large and complex castings, and improving the yield of castings.

Preferably, a vacuum-pumping tube is disposed on the holding furnace and/or the working chamber, the vacuum-pumping tube is connected to a vacuum source, an inert gas replacement pipe is disposed on the holding furnace and/or the working chamber, the inert gas replacement pipe is connected to an inert gas source, and an exhaust passage is further disposed on the working chamber.

Preferably, the number of holding furnaces are four, and a bottom of each holding furnace is disposed on a furnace body walking mechanism, and a furnace body lifting mechanism is further disposed between the furnace body walking mechanism and the holding furnace; the furnace body walking mechanism includes a sliding rail laid on the ground and passing through a lower part of the platform, and a walking wheel disposed on a bottom surface of a furnace body, wherein the sliding rail has two sets arranged in parallel, two holding furnaces are arranged on any one of the sliding rails, and the two holding furnaces on the same sliding rail can move towards and away from each other; the furnace body lifting mechanism includes a spiral lifting mechanism, wherein the furnace body walking mechanism and the furnace body lifting mechanism are both hydraulically controlled.

In order to further facilitate demolding, the lift tube device includes a lift tube upper section disposed on a bottom surface of the platform and connected to the liquid filling port, and a lift tube lower section disposed at a liquid lifting port of the holding furnace. The lift tube upper section includes an upper lift tube disposed on an inner side, a thermal insulation layer wrapped outside the upper lift tube, and an outer casing wrapped around the thermal insulation layer, a top surface of the outer casing is locked to a pressure plate by a screw, and the pressure plate is fixedly connected to the platform, a bottom surface of the outer casing is provided with a locking plate, the locking plate is configured for fixing the upper lift tube, the thermal insulation layer and the outer casing. The pressing plate is provided with an opening, and the lift tube is connected to the liquid filling port through the opening, the locking plate is provided with an opening, the lift tube is connected to the opening, and a lower surface of the opening is provided with a groove expanding outwardly; the thermal insulation layer is provided with a resistance wire and a thermal insulation sleeve, the resistance wire is externally connected to a heating device. The lift tube lower section includes a lower lift tube extending into the holding furnace, and the lower lift tube is extended into and fixed through the liquid lifting port of the holding furnace, an outer ring of the lower lift tube is provided with a sealing ring, the sealing ring is fixed on a top surface of the liquid lifting port. Moreover, through this arrangement, the freezing of the lift tube can be avoided.

The holding furnace includes a furnace body and a graphite crucible installed in the furnace body, the furnace body is provided with a furnace lid, the furnace lid is provided with an air inlet and outlet device connected to the graphite crucible, a heat preservation device is further disposed outside the furnace body, a liquid leakage guide outlet is disposed at a bottom of the furnace body, and a stirring device is disposed at the bottom of the furnace body; the air inlet and outlet device includes an air inlet and outlet port connected to the graphite crucible, and an air inlet and outlet passage corresponding to the air inlet and outlet port, a synchronous sealing device is disposed between the air inlet and outlet passage and the inlet and outlet port, the synchronous sealing device includes a guide sleeve fixedly connected to the air inlet and outlet passage, and a hollow guide rod, one end of the guide rod is inserted into the guide sleeve, and the other end is provided with a boss protruding outwardly. A middle portion of the guide rod is provided with an elastic mechanism, the elastic mechanism includes a fixing block sleeved on the guide rod, a disc spring assembly is disposed between the fixing block and the boss, one end of the disc spring assembly is connected to the fixing block, and the other end is connected to the boss. The synchronous sealing device further includes a sealing ring disposed at the air inlet and outlet port. The heat preservation device includes a resistance band fixedly disposed on an inner side wall of the furnace body, the resistance band is connected to a binding post disposed on an outer side wall of the furnace body by a wire, the resistance band is heated by energizing the binding post, and a temperature detecting device is respectively disposed in the furnace body and the graphite crucible. The liquid leakage guide outlet includes a liquid leakage guide outlet disposed at a lower part of the furnace body, a part from the liquid leakage guide outlet to an inner bottom wall of the furnace body is configured as an inclined surface; the bottom of the furnace body is a flat surface, and a magnetic homogenization device is disposed at the bottom of the furnace body.

Further, the platform is disposed on a frame, the frame includes a column for supporting, the cover body is connected to the platform by a locking device. The locking device includes a locking flange disposed on the platform, an outer edge of the locking flange is provided with a locking tooth A, an outer edge of a lower portion of the cover body is provided with a locking tooth B corresponding to the locking tooth A, and a locking ring is disposed outside the locking tooth A and the locking tooth B. The locking ring is provided with a U-shaped locking ring facing towards the locking tooth A and the locking tooth B, the U-shaped locking ring is used to fix and lock the locking tooth A and the locking tooth B, and a ball mechanism is disposed between a bottom of the locking ring and the platform. A wedge mechanism is respectively disposed between an inner top wall of the U-shaped locking ring and the locking tooth A, and between an inner bottom wall of the U-shaped locking ring and the locking ring B in a circumferential direction. A cylinder piston mechanism is connected to an outer wall of the locking ring, a cylinder body end of the cylinder piston mechanism is fixed on the platform, and a piston end of the cylinder piston mechanism is fixedly connected to the locking ring.

Further, the lift control system includes a compressed gas source, the compressed gas source is provided with a branch connected to each holding furnace, each branch is provided with a solenoid valve, and an interconnection valve is provided between each holding furnace and the working chamber. In addition, a pressure control module is disposed between the solenoid valve and the compressed gas source, a pressure transmitter is further disposed between the pressure control module and the holding furnace. A pressure signal of the holding furnace is fed back through the pressure transmitter, the pressure control module receives the pressure signal and performs pressure control and adjustment through an A/D module of the programmable logic controller (PLC). The PLC is also connected to the human-machine interface industrial computer. In addition, a solenoid valve and a manual valve connected in series are also disposed on a main road of the compressed gas.

Further, the vacuum-pumping system includes a vacuum source, the vacuum source is provided with branches connected to each of the holding furnaces and the working chamber, each of the branches is provided with a solenoid valve, a pressure control module is further disposed on the branch of the holding furnace, and a pressure transmitter is further disposed between the pressure control module and the holding furnace. A one-way throttle valve is further disposed on a branch of the working chamber, and the working chamber is also connected to an exhaust system, the exhaust system is provided with a solenoid valve. The working chamber is also connected to the pressure transmitter, and a manual valve and a solenoid valve are sequentially connected in series on an output main road of the vacuum source.

The inert gas replacement system includes an inert gas source, the inert gas source is provided with branches connected to each of the holding furnaces and the working chamber, and each of the branches is provided with a solenoid valve, a pressure control module is further disposed on the branch of the holding furnace, and a pressure transmitter is further disposed between the pressure control module and the holding furnace. A one-way throttle valve is further disposed on a branch of the working chamber, the working chamber is also connected to an exhaust system, the exhaust system is provided with a solenoid valve, the working chamber is also connected to the pressure transmitter, and a manual valve and a solenoid valve are sequentially connected in series on the output main road of the vacuum source.

A multi-position parallel pressurized casting method for large aluminum alloy castings includes the following steps:

1) preparation before pouring: transferring a refined aluminum melt to four 800 kg holding furnaces through a quantitative delivery device, holding a temperature at 690-720° C., inserting a lower lift tube sprayed with 4-6 mm thick refractory coatings into the liquid lifting port of the holding furnace, locking the lower lift tube with the holding furnace by a bolt; moving the holding furnace to a lower part of a frame platform through the furnace body walking mechanism, then, through the furnace body lifting mechanism, lifting the holding furnace at a rate of 20 mm/s, thus completing the docking and sealing between the air inlet and outlet port of the holding furnace and the air inlet and outlet passage mechanism, and between the upper lift tube and the lower lift tube; placing a resin sand mold on the frame platform and compressing the resin sand mold with the pressure plate, using a sealing gasket to ensure that the sand mold and the lift tube are well sealed; connecting electrode contacts, covering the working chamber, and driving the locking ring to lock the resin sand mold with four cylinder piston mechanisms;

2) synchronous negative pressure and inert gas replacement: opening the interconnection valve between the holding furnace and the working chamber, vacuuming and replacing inert gas from the working chamber, wherein the solenoid valve of the vacuum-pumping tube is first opened, vacuuming is performed by a vacuum pump, when the vacuum degree is reduced to 40-60 KPa, the solenoid valve is closed and the vacuuming is stopped; the solenoid valve of the inert gas replacement pipe is opened, the Ar gas station is opened, so as to fill the holding furnace and the working chamber with Ar gas, when the pressure rises to 120-150 KPa, the solenoid valve is closed to realize the replacement of inert gas, finally, the interconnection valve between the holding furnace and the working chamber is closed;

3) melt quality correction: opening the magnetic homogenization device, wherein an alternative frequency of a magnetic field is 5-20 Hz, a rotating speed of a rotation motor is 60-150 r/min; when a direct current of 10-20 A passes through the coil, a constant magnetic field is generated in iron cores, the iron cores are placed according to a preset structure, and the magnetic lines are scattered in a particular shape in the space; under the effect of the rotation motor, a rotating magnetic field is generated, the aluminum melt moves under the action of the applied rotating magnetic field, achieving the purpose of magnetic homogenization;

4) Synchronous pre-mold filling: calculating pre-mold filling pressures of four lift tube devices according to the theoretical formula $P=\rho hg$ firstly, then carrying out the synchronous pre-mold filling of the four lift tube devices, wherein the pressure control module of the first holding furnace is opened, the liquid level of the lift tube is lifted to a position of the electrode contact mark at a pressurization rate of 0.1-0.2 KPa/s, the pressure control module of the holding furnace is closed by the feedback signal of the A/D module, then the pressure control modules of second holding furnace, third holding furnace, and fourth holding furnace are successively opened for the pre-mold filling, finally, the liquid levels of the aluminum melt of the four lift tubes are lifted to positions at the same height;

5) multi-position synchronous liquid lifting: according to an initially set liquid level pressurization process curve, opening the pressure control module of the holding furnace, the initial pressurization rate is 1.0-1.4 KPa/s, using the electrode contact to capture the liquid surface information, feeding back to the multi-position synchronous mold filling control system through the A/D module, and adjusting the pressurization rates of the four holding furnaces through the pressure control module, and ensuring a simultaneous liquid lifting, when the melt flows to a top of the mold, a top signal light is lighted up and the mold filling is completed;

6) secondary pressurized solidification: during the crusting pressurization stage, increasing the pressure by 5-10 KPa at a pressurization rate of 0.8-1.0 KPa/s, the crystal holding time is 15-30 s, so that a shell of 3-5 mm is formed in the surface layer of the melt; during the crystallization pressurization stage, according to the structural characteristics of the casting, increasing the pressure by 20-30 KPa at a pressurization rate of 1.2-1.6 KPa/s, so that the casting can be continuously and fully fed through the lift tube device and the pouring system under the action of melt pressure, the crystallization holding time is about 1500-1800 s, ensuring that the casting is fully solidified under pressure; and 7) pressure relief: after the crystallization holding time is over, closing the pressure control module of the holding furnace, opening the holding furnace exhaust valve, and directly discharging the compressed air; opening the working chamber exhaust valve to discharge the Ar gas in the working chamber into the Ar gas recovery station for recycling treatment; when the pressures of the holding furnace and the working chamber are less than 3 KPa, the locking ring is unlocked, driven by four cylinder piston mechanisms to lift the working chamber and the cast mold, and the holding furnace and the lift tube are lowered to the bottom through the furnace lifting system, then exit the working area through the horizontal moving mechanism, and the cleaning treatment is performed.

Beneficial Effects

1. Integrating technical advantages such as inert gas atmosphere protection, multi-position synchronous lifting, staged pressurized solidification and proportion integral derivative (PID) pressure precise control, a multi-position parallel pressurized casting device is innovatively designed, which is particularly suitable for manufacturing large and complex castings, especially large and complex aluminum alloy frames, plate shapes, cabins and the like, in the fields of aerospace, weapons, ships, automobiles, electronics, providing equipment and process support for forming high-quality large aluminum alloy castings;

An inner cavity size of the working chamber is Φ4040 mm×2800 mm, a capacity of the holding furnace is 4×800 kg, and a size of the lift tube is 4×Φ160 mm. The independent liquid level pressurized control or the synchronous liquid level pressurized control of the four holding furnaces in any combination can be achieved, the overall molding demand of an aluminum alloy casting having a maximum size of 2450 mm can be met, and a maximum pouring amount of 2600 kg can be achieved.

2. Through the multi-position synchronous mold filling of four lift tubes, the problems of long process and large temperature drop of large aluminum alloy castings are solved, inhibiting melt turbulence, avoiding the occurrence of defects such as cold shut and inclusion, and controlling the content of Fe and S impurity elements within 0.2%. The mold filling is performed in an inert atmosphere, reducing the oxidation in the process of mold filling, and realizing the burning loss of Mg element to less than 1.2%. The multi-position independent pressurized control of the four lift tubes enables the aluminum melt to be subjected a smooth mold filling in the mold cavity in an approximate laminar flow way, specifically, improving the local solidification and feeding capacity, reducing or eliminating the dispersibility and shrinkage defects of castings, and making the pinhole and porosity of large aluminum alloy castings reach Grade I. The melt quality dynamic correction of the aluminum melt is carried out by the magnetic homogenization device, achieving the composition fluctuation of the core elements such as Cu and Mg of the aluminum alloy casting is less than ±0.45%.

3. Multi-position parallel pressurized casting device has the characteristics of high automation, clear operation flow, high stability and strong applicability. Using PID liquid surface pressurized precise control, the mold filling pressure control accuracy is ±0.3 KPa. All pressurization process parameters, pressurized measurement data and temperature measurement data are recorded and saved by human-machine interface and industrial computer for the use in optimization of process parameters. The casting process expert system in the industrial computer is applied to realize the automatic setting of the casting process parameters of similar castings. The device can be widely applied in high-quality forming of large aluminum-silicon, aluminum-copper and aluminum-magnesium alloy castings, and has high application value and great industrial potential.

DESCRIPTION OF REFERENCE NUMERALS

1 platform; 2 holding furnace; 201 furnace body; 202 graphite crucible; 203 furnace lid; 204 liquid leakage guide outlet; 3 frame; 4 cover body; 401 support lug; 402 locking tooth B; 5 locking flange; 501 locking tooth A; 6 locking ring; 601 U-shaped groove; 7 cylinder piston mechanism; 8 ball mechanism; 9 wedge mechanism; 10 furnace body walking mechanism; 1001 sliding rail; 11 furnace body lifting mechanism; 12 air inlet and outlet device; 13 lift tube device; 1301 lift tube upper section; 1302 lift tube lower section; 1301*a* upper lift tube; 1301*b* thermal insulation layer; 1301*c* outer casing; 1301*d* pressure plate; 1301*e* locking plate; 1301*f* groove; 1301*g* resistance wire; 1301*h* thermal insulation sleeve; 1301*i* positioning plate; 1301*j* binding post; 1302*a* liquid lifting port; 1201 air inlet and outlet port; 1202 air inlet and outlet passage; 1204 synchronous sealing device; 1204*a* guide sleeve; 1204*b* guide rod; 1204*c* guide seat; 1204*d* fixing block; 1204*e* disc spring assembly; 14 resistance band; 15 furnace body binding post; 16 furnace body temperature measuring device; 17 melt temperature measuring device; 18 magnetic homogenization device.

DETAILED DESCRIPTION OF THE EMBODIMENTS

The specific embodiments of the present invention are further described in detail below with reference to the drawings, but the present invention is not limited to the embodiments. Any modification or substitution made based on the basic spirit of the embodiments is still within the scope of the claims of the present invention.

Embodiment 1

Figure 1:
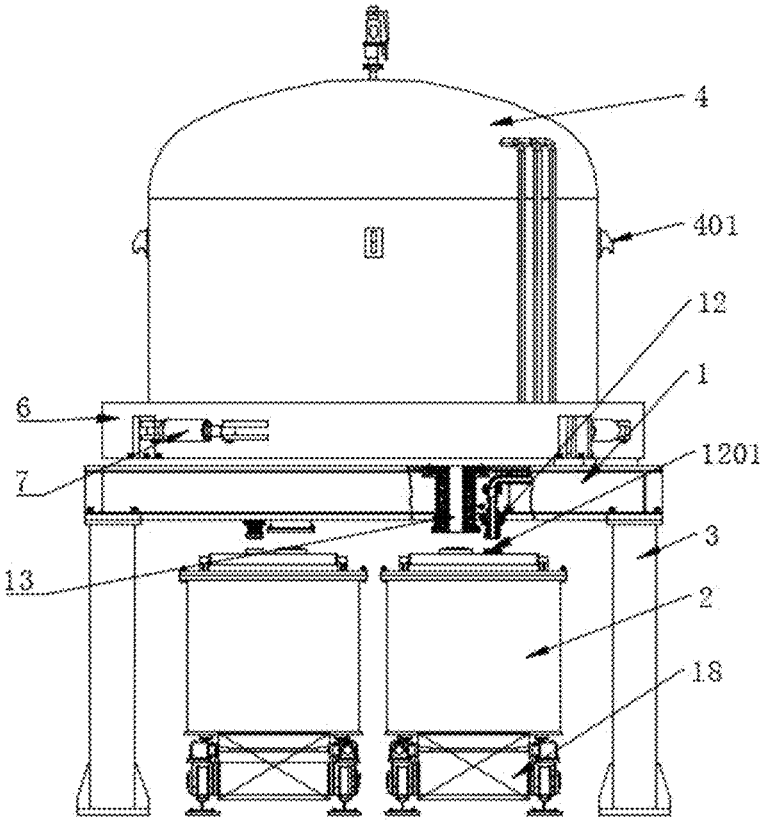
FIG. 1 is a front view of a multi-position parallel pressurized casting device.
Figure 2:
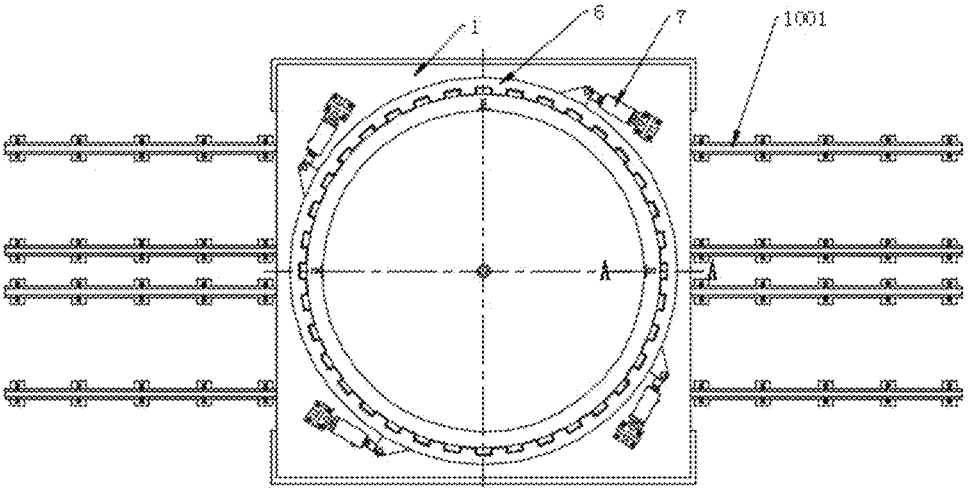
FIG. 2 is a top view of FIG. 1.
Figure 3:
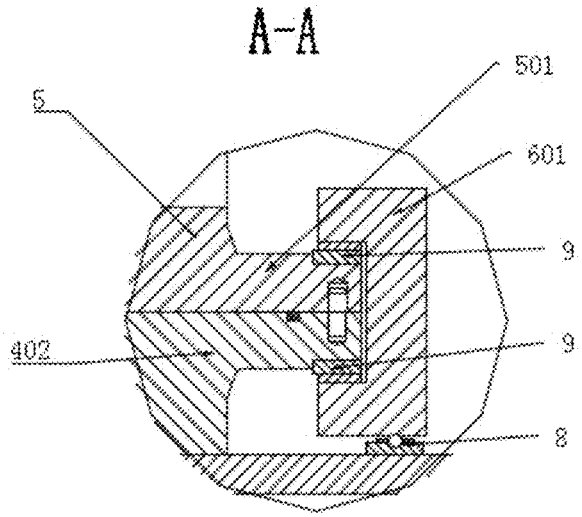
FIG. 3 is a cross-sectional view of FIG. 2 along an A-A direction.
Figure 4:
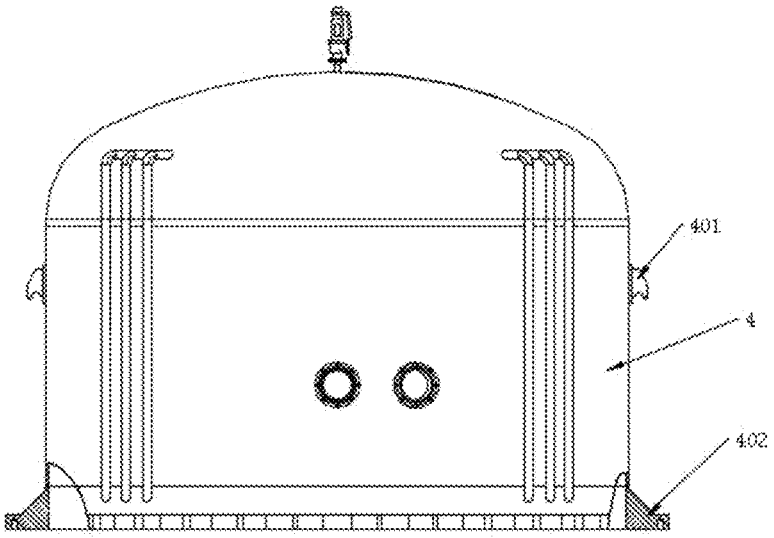
FIG. 4 is a structural view of a cover body of a multi-position parallel pressurized casting device.
Figure 5:
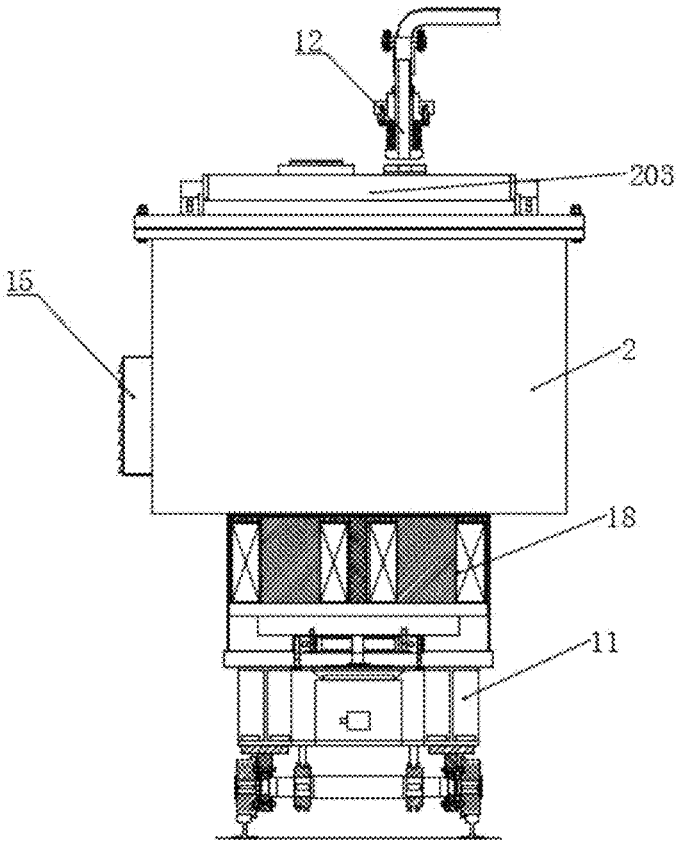
FIG. 5 is a structural view of a holding furnace of a multi-position parallel pressurized casting device.
Figure 6:
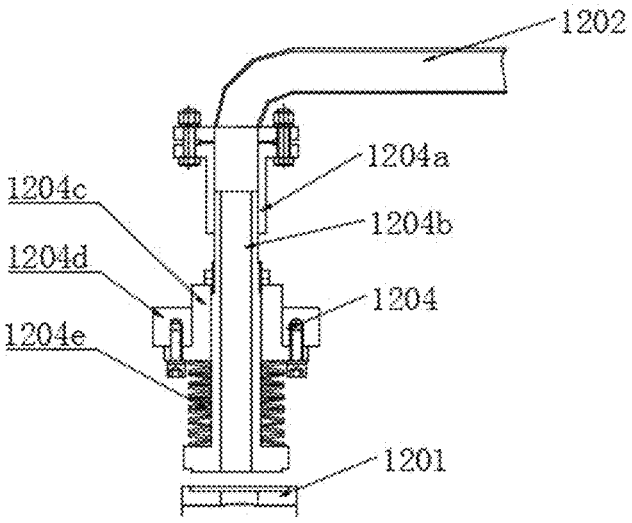
FIG. 6 is a structural view of a lift tube device of a multi-position parallel pressurized casting device.
Figure 7:
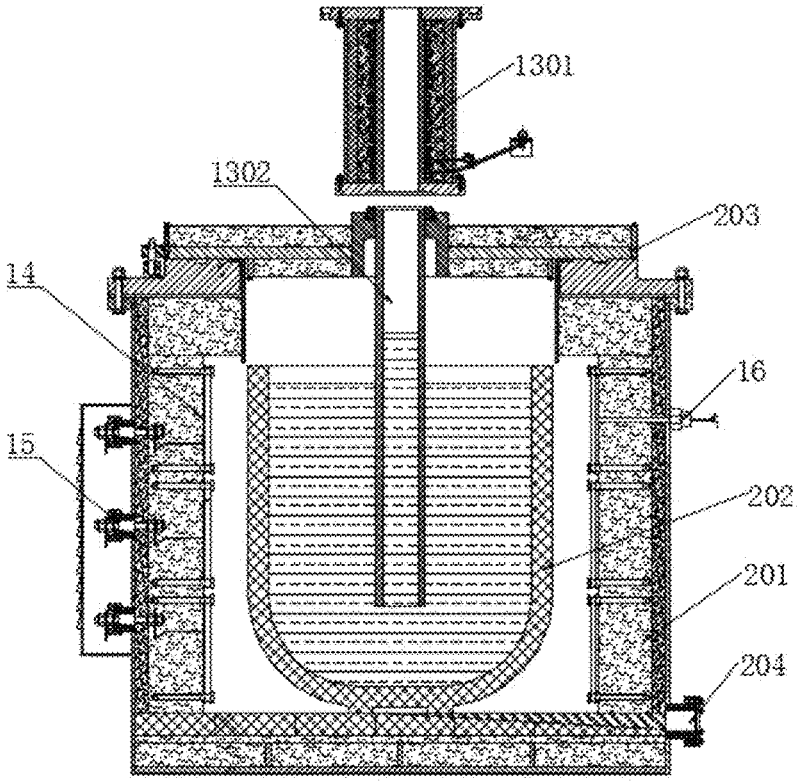
FIG. 7 is a structural view of a furnace body of a multi-position parallel pressurized casting device.
Figure 8:
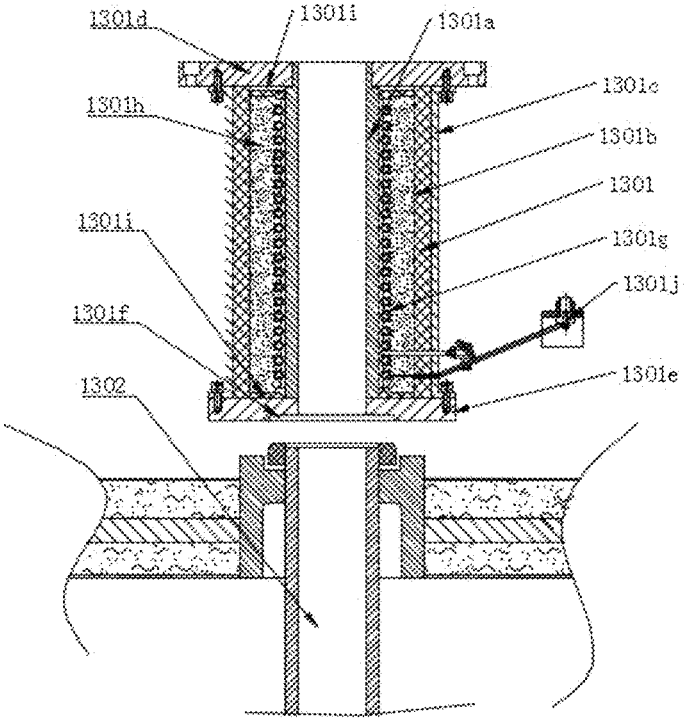
FIG. 8 is a diagram of an air inlet and outlet mechanism of a multi-position parallel pressurized casting device.
Figure 9:
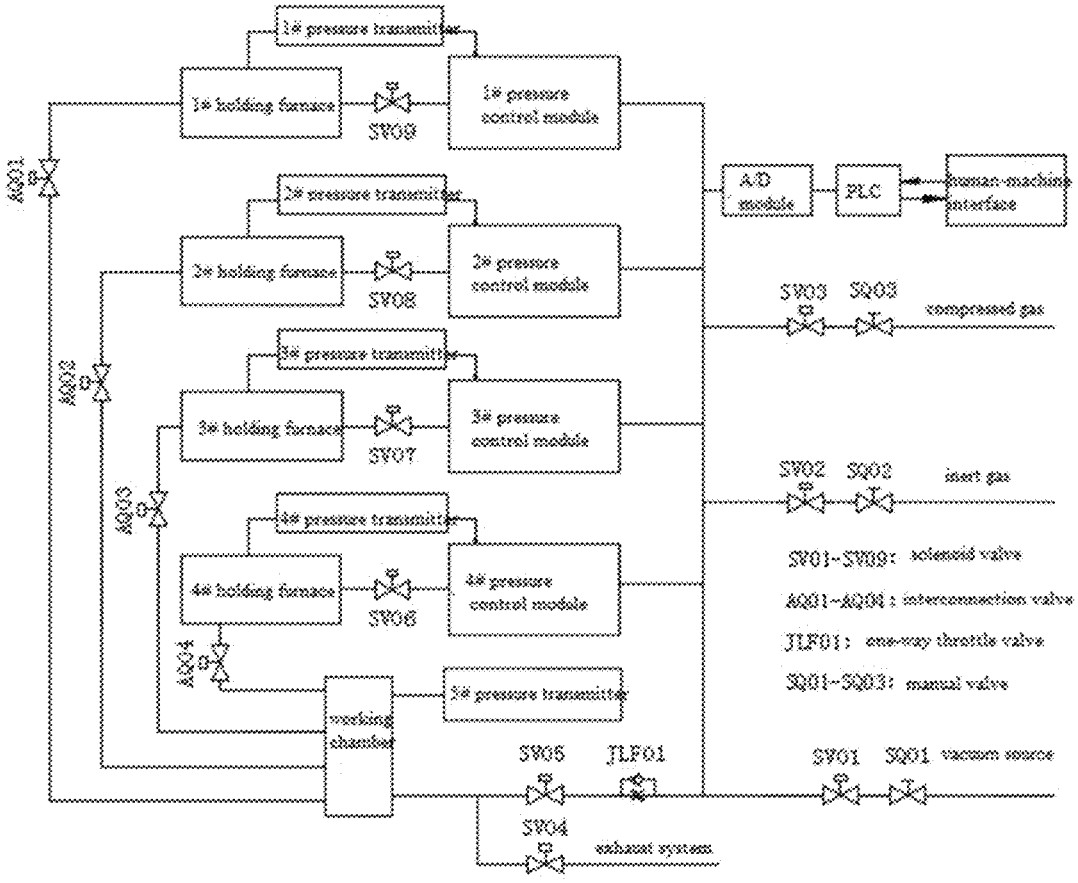
FIG. 9 is a diagram of a control system of a multi-position parallel pressurized casting device.
Figure 10:
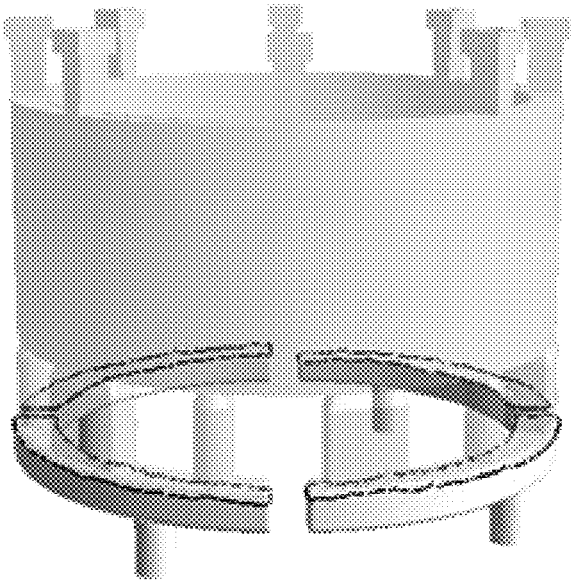
FIGS. 10-14 are diagrams showing mold filling effects of castings.
Figure 11:
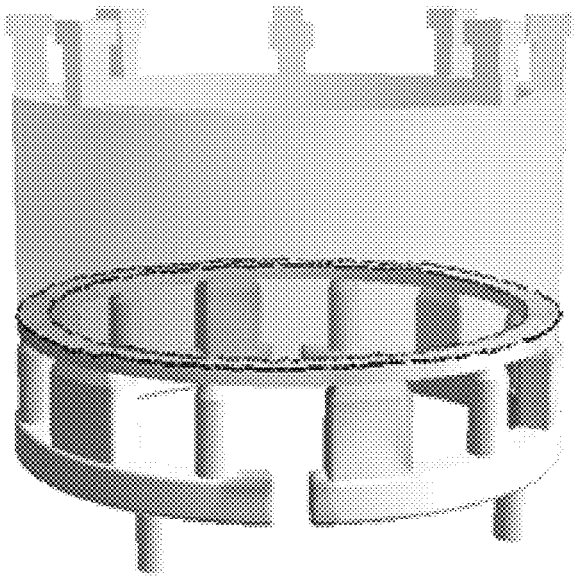
Figure 12:
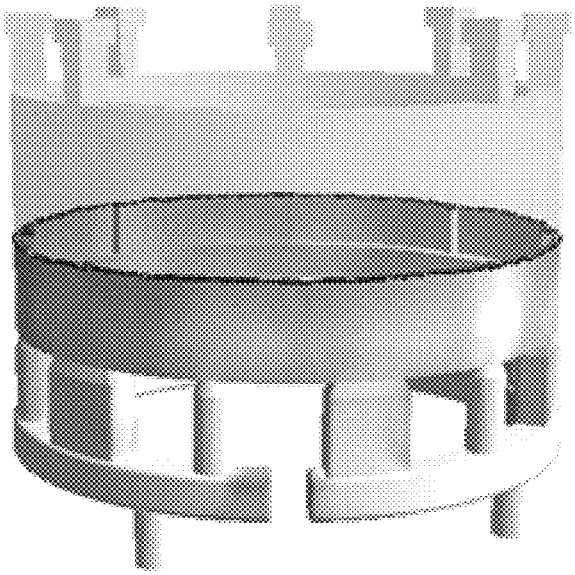
Figure 13:
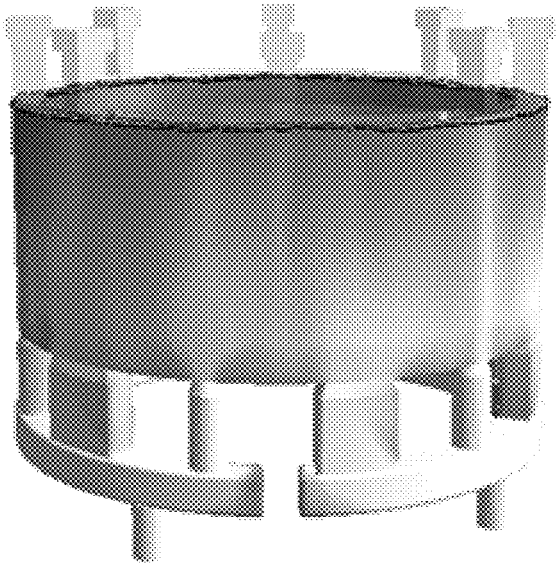
Figure 14:
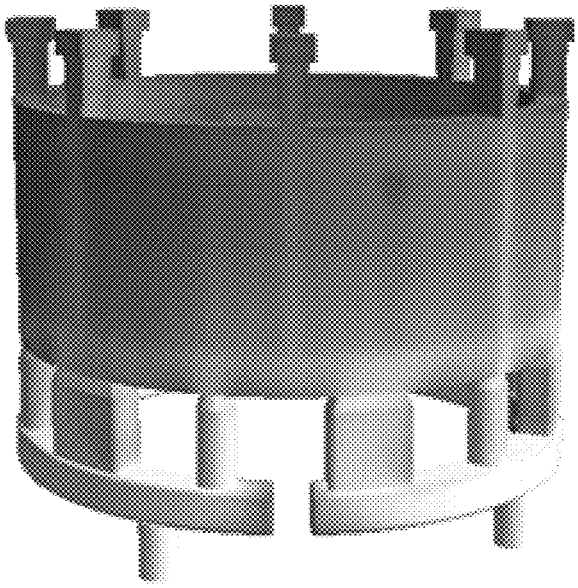

As shown in FIGS. 1-9, a multi-position parallel pressurized casting device for large aluminum alloy castings is provided in the present embodiment. The casting device is suitable for manufacturing large and complex castings, especially large and complex aluminum alloy frames, plate shapes, cabins and the like, in the fields of aerospace, weapons, ships, automobiles, electronics, etc. The casting device can solve the problems of turbulence, cold shut, misrun, excessive pinholes and porosity, and the risk of oxidation in the existing manufacturing process of these large and complex castings, and improves the yield of castings.

Specifically, the casting device of the embodiment includes the platform 1, a top surface of the platform is a working surface, and a bottom of the platform is provided with the holding furnace 2. The number of holding furnaces are two or more, each of the two or more holding furnaces is connected to a liquid filling port corresponding to the working surface through a separate lift tube device, and the holding furnace is a lower chamber. The platform is disposed on the frame 3, the frame includes a column disposed at a lower portion of the platform, and the platform is supported by the column. In the present embodiment, the platform and the column are mesh-like welded structural members, and are locked by bolting. The cover body 4 is further disposed on an upper portion of the platform, the cover body and the working surface form a working chamber for mounting sand mold, and the working chamber is an upper chamber.

As for the upper chamber, a cover body is further disposed on the working surface, once the sand mold is placed on the working surface, before casting, the cover body is placed on the sand mold to form an airtight working chamber, until the casting is completed, the cover body is removed, and a casting is taken out.

Since the casting device of the present embodiment is suitable for a large casting, a volume of the cover body is inevitably larger than a volume of the sand mold. In the embodiment, the cover body has a rotating middle casing, having a shape such as a cylindrical shape, a square shape, and a polygonal shape. A bottom of the middle casing has an opening shape, a top of the middle casing has a head cover hermetically connected thereto, and the head cover has a semicircular shape protruding upwards. In order to facilitate the movement and installation of the cover body, support lugs 401 are disposed on both sides of the cover body.

In order to stably install the cover body on the platform, the cover body and the platform are locked by a locking device. The locking device includes the locking flange 5 arranged on the platform, wherein the locking flange is a rotating structure disposed on the platform and having a same shape as the outer edge of the bottom of the middle casing of the cover body, and the locking flange is provided with the locking tooth A 501 facing outwardly. A plurality of the locking teeth A are evenly arranged along the outer edge of the locking flange, and a spacing between two adjacent locking teeth A is not smaller than a width of the locking tooth A. In addition, the locking device further includes the locking tooth B 402 corresponding to the locking tooth A and disposed at an outer edge of the lower portion of the middle casing of the cover body, the locking tooth A and the locking tooth B are identical in shape and number, so that the locking tooth A and the locking tooth B overlap each other. The locking device further includes the locking ring 6 disposed outside the locking tooth A and the locking tooth B, and the locking ring has a rotating shape corresponding to the outer shape of the locking flange, but the diameter of the locking ring is slightly larger than that of the locking flange. The locking ring is provided with the U-shaped locking groove 601 facing towards the locking tooth A and locking tooth B, and the distribution and quantity of the U-shaped locking groove are consistent with that of the locking tooth A or the locking tooth B. Moreover, a width of the U-shaped locking groove is not greater than a spacing between two adjacent locking teeth A or two adjacent locking teeth B, an internal height of the U-shaped locking groove is not less than a sum of heights of the locking tooth A and the locking tooth B, and the U-shaped locking groove can wrap the locking tooth A and the locking tooth B to fix and lock the cover body. In addition, the cylinder piston mechanism 7 is connected to an outer wall of the locking ring, and a cylinder body end of the cylinder piston mechanism is fixed on the platform, and a piston end of the cylinder piston mechanism is fixedly connected to the locking ring. The rotation of the locking ring is driven by the cylinder piston mechanism.

In actual use, before installing the cover body, the U-shaped locking groove on the locking ring is ensured to be located between the two locking teeth B. Subsequently, after installing the sand mold, the cover body is placed on the platform by a hoisting mechanism, so that the cover body is placed on the locking flange on the platform, and the locking tooth A on the cover body are aligned with the locking tooth B on the locking flange. Then the locking ring is driven to rotate by the cylinder piston mechanism, so that the U-shaped locking groove rotates to the position of the locking tooth A and the locking tooth B, and wraps the locking tooth A and the locking tooth B, and then the piston of the cylinder piston is kept in the position.

In addition, as another embodiment of the present embodiment, in order to ensure the rotational reliability and smoothness of the locking ring on the platform, the ball mechanism 8 is disposed between a bottom of the locking ring and the platform.

As another embodiment of the present embodiment, a wedge mechanism is respectively arranged between the inner top wall of the U-shaped locking groove and the locking tooth A, and between the inner bottom wall of the U-shaped locking ring and the locking tooth B in a circumferential direction. The wedge mechanism can be divided into two parts, one part is arranged on a top surface of the locking tooth A and a bottom surface of the locking tooth B, and the other part is arranged on the top wall and bottom wall of the inner side of the U-shaped locking groove, and the two parts are matched with each other. The two parts of the wedge have mutually matched inclined surfaces, that is, the two parts of the wedge are respectively in a triangular shape when viewed from cross section, and a rectangular shape is formed after the matching of the two parts. The inclined surface is disposed along a circumferential direction of the locking ring, and when the locking ring is in a locked state, the two triangular inclined surfaces must be ensured to be matched with each other. Once the locking ring rotates to a predetermined position, due to the limitation of the inclined surfaces, the locking ring cannot continue to rotate, which ensures the reliability of the installation.

As for the lower chamber, the number of the holding furnaces 2 can be more than one, for example, two, three, four, five, six, seven, eight or even more. However, four holding furnaces are provided in the present embodiment, each holding furnace corresponds to at least one liquid filling port on the platform, and a lift tube device is arranged between the each holding furnace and the corresponding liquid filling port.

The furnace body walking mechanism 10 is disposed at a bottom of the heating furnace, and the furnace body lifting mechanism 11 is further disposed between the furnace body walking mechanism and the heating furnace. The furnace body walking mechanism includes the sliding rail 1001 laid on the ground and passing through a lower portion of a frame platform, and a walking wheel, disposed on a bottom surface of the furnace body. The sliding rails are two sets arranged in parallel, and two holding furnaces are arranged on any one of the sliding rails, the holding furnaces move on the sliding rails by the walking wheel, the two holding furnaces on the same sliding rail are separately controlled, and may move towards or away from each other, and the sliding rail can be either single rail type or double rail type. In the present embodiment, the sliding rail is a double rail type, and each sliding rail is provided with two heating furnaces, the two holding furnaces are respectively disposed at two ends of the sliding rail when not in operation, and move towards each other to a bottom of the platform by the walking mechanism when in operation. The furnace body lifting mechanism is a spiral lifting mechanism.

When not in operation, the holding furnaces move outside the frame through the furnace body walking mechanism, when in operation, the holding furnaces move to the bottom of the platform through the furnace body walking mechanism, and correspond to the corresponding liquid filling port. Then, the furnace body lifting mechanism makes the holding furnace to be connected to the platform through the lift tube device, so as to ensure that the upper chamber and the lower chamber are interconnected for filling. In order to ensure the reliability and accuracy of the operation, the furnace body walking mechanism and the furnace body lifting mechanism in the present embodiment are both hydraulically controlled.

The holding furnace includes the furnace body 201 and the graphite crucible 202 installed in the furnace body, the furnace lid 203 is disposed on the furnace body, the liquid leakage guide outlet 204 is disposed at a bottom of the furnace body, the liquid leakage guide outlet is disposed on an outer wall of an lowermost portion of the furnace body, and liquid leakage guide outlet is provided with an inclined surface facing toward an inner bottom of the furnace body.

The furnace lid is provided with the air inlet and outlet device 12 connected to the graphite crucible, the lift tube device 13 is further disposed between the furnace lid and the platform, a heat preservation device is further disposed on the furnace body, and a stirring device is disposed at a bottom of the furnace body.

Specifically, the lift tube device 13 includes the lift tube upper section 1301 disposed on a bottom surface of the platform and connected to the liquid filling port, and the lift tube lower section 1302 disposed at the liquid lifting port on the furnace lid of the holding furnace.

The lift tube upper section includes the upper lift tube 1301*a* disposed on the inner side, the thermal insulation layer 1301*b* wrapped around the upper lift tube, and the outer casing 1301*c* wrapped around the thermal insulation layer. A top surface of the outer casing is locked to the pressure plate 1301*d* by screws. The pressure plate is fixedly connected to the platform. A bottom surface of the outer casing is connected to the locking plate 1301*e*, and the locking plate is used to fix the upper lift tube, the thermal insulating layer and the outer casing. Moreover, the pressure plate and the locking plate are respectively provided with an opening, the upper lift tube is connected to the liquid filling port through the opening of the pressing plate, and a size of the opening of the upper lift tube is the same as that of the locking plate, the lower surface under the opening is provided with a groove 1301*f* expanding outwardly. The thermal insulation layer is provided with the resistance wire 1301*g* and the thermal insulation sleeve 1301*h*, and the positioning plate 1301*i* is respectively disposed between the upper surface of the thermal insulation sleeve and the pressure plate, and between the lower surface of the thermal insulation sleeve and the locking plate. The resistance wire is connected to the heating device through a wire or other conductive line, and the heating device is an existing device capable of energizing the resistance wire to generate heat. For example, the resistance wire is connected to the binding post 1301*j* through a wire, the wire is disposed in a porcelain sleeve, a fixing plate is provided outside the binding post, and an insulation sleeve is further disposed on the binding post. Moreover, the resistance wire in the present embodiment is connected to a temperature measuring thermocouple, and a temperature of the resistance wire can be monitored in real time. The lift tube lower section 1302 can be directly inserted into the liquid lifting port 1302*a* provided on the furnace lid, and extend into the graphite crucible. An upper portion of the lift tube is provided with a boss protruding outwardly, a size of the boss is larger than that of the liquid lifting port, and the boss can be directly fixed to the furnace lid or be fixed by a screw. In addition, a sealing ring is disposed on an outer edge of a top portion of the lift tube lower section, the sealing ring is fixed on the top surface of the liquid lifting port. When the lift tube upper section and the lift tube lower section are movably connected, the sealing ring can be placed in the groove on the pressure plate and tightly abuts against the lift tube upper section and the lift tube lower section to seal the lift tube upper section and the lift tube lower section.

When not in operation, the lift tube upper section and the lift tube lower section are separated from each other, and when in operation, the lift tube lower section moves to the lower portion of the lift tube upper section along with the holding furnace, and through the lifting and lowering of the furnace body, the lift tube upper section and the lift tube lower section can be connected to each other. The sealing ring is compressed when the lift tube upper section is connected to the lift tube lower section to realize the sealing between the lift tube upper section and the lift tube lower section, thereby ensuring that leakage will not occur during the mold filling process. When the casting is completed, the lower end of the lift tube can be directly removed without taking the cast mold away, thus preventing the lift tube from freezing, and further preventing the phenomena of ineffective feeding and failure of pulling out the lift tube, thereby the feeding effect of the casting is greatly improved, and the efficiency of casting production and the quality of the casting are ensured.

The air inlet and outlet device includes the air inlet and outlet port 1201 connected to the graphite crucible and the air inlet and outlet passage 1202 corresponding to the air inlet and outlet ports. The synchronous sealing device 1204 is disposed between the air inlet and outlet passage and the air inlet and outlet port, and the synchronous sealing device includes the guide sleeve 1204*a* fixedly connected to the air inlet and outlet pipe, and the hollow guide rod 1204*b*. One end of the guide rod is inserted into the guide sleeve, and the other end of the guide rod is provided with a boss protruding outwardly. A middle portion of the guide rod is provided with an elastic mechanism, and the elastic mechanism includes the guide seat 1204*c* sleeved in the middle of the guide rod. The guide seat is fixed to the frame by the fixing block 1204*d*, and the disc spring assembly 1204*e* is disposed between the guide seat and the boss of the guide rod. One end of the disc spring assembly is connected to the guide seat, and the other end is connected to the boss. A protrusion protruding outwardly is further disposed in a middle portion of the boss, so that an outer edge of the boss forms a groove. A sealing ring can be placed in the groove. A concave portion corresponding to the protrusion may be disposed at the air inlet and outlet port, thereby the protrusion is matched with the concave portion, and the sealing ring is located between the protrusion and the concave portion to be compressed.

When not in operation, the air inlet and outlet port and the air inlet and outlet pipe are separated from each other, and when in operation, the air inlet and outlet port moves to underside position under the guide rod of the synchronous sealing device along with the holding furnace, during the lifting of the holding furnace, the air inlet and outlet port is connected to the guide rod of the synchronous sealing device. The sealing ring disposed at the air inlet and outlet port contacts and compresses a bottom surface of the guide rod when the air inlet and outlet port is connected to the guide rod of the synchronous sealing device, thereby ensuring that the compressed gas does not leak during the mold filling process, and also ensuring that the molten liquid does not leak, and the connection of the air inlet and outlet mechanism is completed. After the casting is completed, the holding furnace may be directly removed by the furnace body lifting mechanism and the furnace body walking mechanism without installing or disassembling the air inlet and outlet mechanism, and airtightness can be ensured. More importantly, through this arrangement, the air inlet and outlet pipe and the synchronous sealing device are arranged on the frame, and do not move with the movement of the holding furnace, reflecting the cleanliness, safety and reliability of the arrangement.

A heat preservation device of the holding furnace includes the resistance band 14 fixedly disposed on an inner side wall of the furnace body. The resistance band is connected to the furnace body binding post 15 disposed on an outer side wall of the furnace body through a wire, and the resistance band is heated by energizing the furnace body binding post. The furnace body temperature measuring device 16 is disposed in the furnace body, and the melt temperature measuring device 17 is disposed in the graphite crucible. The furnace body is heated by the heating device to ensure the temperature of the melt liquid. Moreover, the temperature inside the furnace body must be ensured to be higher than the temperature inside the graphite crucible, and the temperature in the furnace body and the temperature in the graphite crucible can be detected in real time by the temperature detecting device.

The liquid leakage guide outlet includes a liquid leakage guide outlet disposed at the lower part of the furnace body, and a part from the liquid leakage guide outlet to a middle part of an inner bottom wall of the furnace body is configured as an inclined plane. This is the conventional setting of most holding furnaces, and will not be described in detail here.

A bottom of the furnace body is a flat surface, the magnetic homogenization device 18 is disposed at the bottom of the furnace body, the bottom of the furnace body is a flat surface, and a magnetic stirring device is disposed at the bottom of the furnace body. The magnetic stirring device is an existing mechanism, and the magnetic homogenization is achieved by generating a rotating magnetic field. The magnetic stirring device in the present embodiment is a commercially available product, which is purchased from Hunan Kemaida Electric Co., Ltd., and the specific model is determined according to the volume of the holding furnace.

The present embodiment further provides a control system for the casting device. In the present embodiment, a vacuum-pumping system and an inert gas replacement system for the upper chamber and the lower chamber are provided, and a lift control system is further provided for liquid lifting and mold filling of the holding furnace.

The lower chamber is four holding furnaces, i.e. a first holding furnace, a second holding furnace, a third holding furnace and a fourth holding furnace, respectively, and the upper chamber is the working chamber. Each of the holding furnaces moves to be connected to the working chamber through the furnace body walking mechanism and the furnace body lifting mechanism. A channel is respectively arranged between the four holding furnaces and the working chamber, the channel can be a lift tube. Moreover, the channel is further provided with interconnection valves, i.e., interconnection valve AQ01, interconnection valve AQ02, interconnection valve AQ03 and interconnection valve AQ04, respectively. An exhaust passage is further provided on the working chamber, and the exhaust passage includes an exhaust duct and the solenoid valve SV04 disposed on the exhaust duct.

The vacuum-pumping system includes a vacuum source, the vacuum source is divided into five branches after passing through the manual valve SQ01 and the solenoid valve SV01, and the five branches are respectively connected to the first holding furnace, the second holding furnace, the third holding furnace, the fourth holding furnace and the working chamber. The first pressure control module is disposed on the first holding furnace and the branch of the vacuum source, the solenoid valve SV09 is disposed between the first pressure control module and the first holding furnace, and the first pressure transmitter is further disposed between the first holding furnace and the first pressure control module. The second pressure control module is disposed on the second holding furnace and the branch of the vacuum source, the solenoid valve SV08 is disposed between the second pressure control module and the second holding furnace, and the second pressure transmitter is further disposed between the second holding furnace and the second pressure control module. The third pressure control module is disposed on the third holding furnace and the branch of the vacuum source, the solenoid valve SV07 is disposed between the third pressure control module and the third holding furnace, and the third pressure transmitter is further disposed between the third holding furnace and the third pressure control module. The fourth pressure control module is disposed on the fourth holding furnace and the branch of the vacuum source, the solenoid valve SV06 is disposed between the fourth pressure control module and the fourth holding furnace, and the fourth pressure transmitter is further disposed between the fourth holding furnace and the fourth pressure control module. A one-way throttle valve JLF01 and a solenoid valve SV05 are disposed on the working chamber and the branch of the vacuum source, and the 5# pressure transmitter is further connected to the working chamber.

The inert gas replacement system includes an inert gas source, and the inert gas source is divided into five branches after passing through the manual valve SQ02 and the solenoid valve SV02, and the five branches of the inert gas source are arranged in a same way as the five branches of the vacuum source. Alternatively, the vacuum source and the inert gas source share the five branches. It will not be described in detail here.

The lift control system includes a compressed gas source, and the compressed gas source is connected to the inlet and outlet tubes of the first-fourth holding furnaces through a manual valve SQ03 and a solenoid valve SV04, respectively, and forms four branches. The four branches are arranged in a same way as the branch between the vacuum source and the first-fourth holding furnaces, or is a shared branch. It will not be described in detail here.

In addition, the first-fourth holding furnaces and the working chamber are also connected to the A/D module, the A/D module is connected to the PLC control system, and the PLC control system is connected to the human-machine interface industrial computer. The A/D module converts the received analog signal into a digital signal and then processes the digital signal through the PLC, reflects on the human-machine interface, and issues commands to the pressure control module through the human-machine interface to achieve precise control of the pressure.

In addition, the present embodiment further provides a casting method of the casting device, including the following steps.

1) Preparation before pouring: the refined aluminum melt is transported to four holding furnaces through the quantitative delivery device for use, the holding temperature is 690-720° C., specifically the holding temperature can be but not limited to 690° C., 700° C. or 720° C.; the lower lift tube sprayed with refractory coatings having a thickness of 4 mm, 5 mm or 6 mm is inserted into the liquid lifting port of the holding furnace, and is locked with the holding furnace by a bolt; the holding furnace moves to the lower part of the frame platform through the furnace body walking mechanism, and then through the furnace body lifting mechanism, the holding furnace is lifted at a rate of 20 mm/s, thus completing the connections and sealings between the air inlet and outlet port of the holding furnace and the air inlet and outlet pipe mechanism, and between the lift tube upper section and the lift tube lower section; the resin sand mold is placed on the frame platform and is compressed tightly by the pressure plate to ensure that the sand mold and the lift tube device are well sealed; then the electrode contacts are connected, the working chamber is covered, and the locking ring is driven by the four cylinder piston mechanisms to lock the resin sand mold.

2) Synchronous negative pressure and inert gas replacement: the interconnection valves AQ01, AQ02, AQ03 and AQ04 between the holding furnace and the working chamber are opened, vacuuming and inert gas replacement are performed in the working chamber, firstly, the manual valve SQ01 and the solenoid valve SV01 of the vacuum line are opened, a vacuum pump is used to perform vacuuming, when the vacuum degree is reduced to 40-60 KPa, specifically the vacuum degree can be but not limited to 40 KPa, 50 KPa, 60 KPa, the solenoid valve SV01 is closed to stop vacuuming; the manual valve SQ02 and solenoid valve SV02 of inert gas line are opened, the Ar gas station is opened, and the Ar gas is introduced into the holding furnace and the working chamber. When the pressure rises to 120-150 KPa, optionally the pressure can be but not limited to 120 KPa, 130 KPa or 150 KPa, the solenoid valve SV02 is closed to achieve the inert gas replacement, and finally the interconnection valves AQ01, AQ02, AQ03 and AQ04 between the holding furnace and working chamber are closed.

3) Melt quality correction: the magnetic homogenization device is opened, an alternative frequency of the magnetic field is 5-20 Hz, optionally the alternative frequency can be but not limited to 5 Hz, 10 Hz or 20 Hz, the rotating speed of the rotation motor is 60-150 r/min, optionally the rotating speed can be but not limited to 60 r/min, 100 r/min or 150 r/min, when a direct current of 10-20 A passes through the coil, optionally the current can be but not limited to 10 A, 15 A or 20 A, a constant magnetic field is generated in the iron core, the iron core is placed according to a preset structure, the magnetic lines are scattered in a particular shape in space, and under the action of the rotation motor, a rotating magnetic field is generated to make the aluminum melt move under the action of the external rotating magnetic field, achieving the purpose of magnetic homogenization.

4) Synchronous pre-mold filling: firstly, according to the theoretical formula $P=\rho hg$, the pre-mold filling pressure of each lift tube device of the four holding furnaces is calculated, and then the synchronous pre-mold filling of the lift tube device is carried out, firstly, the first pressure control module of the first holding furnace is opened, the liquid level of the lift tube is lifted to the position of the electrode contact mark at a pressurization rate of 0.1-0.2 KPa/s, specifically the pressurization rate can be but not limited to 0.1 KPa/s, 0.15 KPa/s or 0.2 KPa/s, the first pressure control module of the first holding furnace is closed by the feedback signal of the A/D module, and then the second pressure control module, third pressure control module, and fourth pressure control module of the second holding furnace, third holding furnace, and fourth holding furnace are opened in sequence for the pre-mold filling, finally the liquid levels of the aluminum melts of the four lift tubes are lifted to the same level.

5) Multi-position synchronous liquid lifting: according to the initially set liquid level pressurization process curve, the pressure control module of the holding furnace is opened, the initial pressurization rate is 1.0-1.4 KPa/s, the pressurization rate can be but not limited to 0.1 KPa/s, 1.0 KPa/s or 1.4 KPa/s, the electrode contacts are used to capture the liquid level information, the liquid level information is fed back to the multi-position synchronous filling control system through the A/D module, the pressurization rates of the four holding furnaces are adjusted through the pressure control module to ensure the simultaneous liquid lifting of the castings. When the melt flows to the top of the cast mold, the top signal light is lighted up, and the mold filling is completed.

6) Secondary pressure solidification: during the crusting pressurization stage, the pressure is raised by 5-10 KPa at a pressurization rate of 0.8-1.0 KPa/s, optionally the pressure can be but not limited to 5 KPa, 8 KPa or 10 KPa, and the pressurization rate can be but not limited to 0.8 KPa/s, 0.9 KPa/s or 1.0 KPa/s, the crystal holding time is 15-30 s, optionally the crystal holding time can be but not limited to 15 s, 20 s or 30 s, so that a 3-5 mm shell forms on the surface of the melt, optionally the shell can be but not limited to 3 mm, 4 mm or 5 mm; during the crystallization pressurization stage, according to the structural characteristics of the casting, the pressure is increased by 20-30 KPa at a pressurization rate of 1.2-1.6 KPa/s, optionally the pressure can be but not limited to 20 KPa, 25 KPa or 30 KPa, and the pressurization rate can be but not limited to 1.2 KPa/s, 1.4 KPa/s or 1.6 KPa/s, so that the casting can be continuously and fully fed through the lift tube device and the pouring system under the action of melt pressure. The crystallization holding time is about 1500-1800 s, optionally the crystallization holding time can be but not limited to 1500 s, 1650 s or 1800 s, to ensure that the casting is fully solidified under pressure.

7) Pressure relief: after the crystallization holding time is over, the holding furnace pressure control module is closed, the holding furnace exhaust valve is opened, and the compressed air is directly discharged; the working chamber exhaust valve is opened to discharge the Ar gas in the working chamber into the Ar gas recovery station for recycling treatment; when the pressures of the holding furnace and the working chamber are less than 3 KPa, the locking ring is driven to open by four cylinder piston mechanisms, the working chamber and the cast mold are removed, and the holding furnace and the lift tube are lowered to the bottom by the furnace body lifting system, and then exit from the working area through the horizontal moving mechanism, the cleaning process is carried out.

Using the casting device and method of the present embodiment, the following advantages are achieved: 1. integrating technical advantages such as inert gas atmosphere protection, multi-position synchronous lifting, staged pressurized solidification and proportion integral derivative (PID) pressure precise control, a multi-position parallel pressurized casting device is innovatively designed, which is suitable for manufacturing large and complex castings, especially large and complex aluminum alloy frames, plate shapes, cabins and the like, in the fields of aerospace, weapons, ships, automobiles, electronics, providing equipment and process support for high-quality forming of large aluminum alloy castings; an inner cavity size of the working chamber is Φ4040 mm×2800 mm, a capacity of the holding furnace is 4×800 kg, and a size of the lift tube is 4×Φ160 mm, the independent liquid surface pressurized control or synchronous liquid surface pressurized control of four holding furnaces in any combination can be achieved, the overall molding demand of maximum size of 2450 mm aluminum alloy castings can be met, and a maximum pouring amount of 2600 kg can be achieved. 2. Through the multi-position synchronous filling of four lift tubes, the problems of long process and large temperature drop of large aluminum alloy castings are solved, inhibiting melt turbulence, avoiding the occurrence of defects such as cold shut and inclusion, and controlling the content of Fe and S impurity elements within 0.2%; performing mold filling in an inert atmosphere can reduce the oxidation in the process of mold filling, and realize the burning loss of Mg element to less than 1.2%; the multi-position independent pressurized control of the four lift tubes is used to improve local solidification and shrinkage capacity, reduce or eliminate the dispersibility and shrinkage defects of castings, thus making the pinhole and porosity of large aluminum alloy castings reach to Grade I.

The melt quality dynamic correction of the aluminum melt is carried out by the magnetic homogenization device, achieving the composition fluctuation of the core elements such as Cu and Mg of the aluminum alloy casting is less than ±0.45%. 3. Multi-position parallel pressurized casting device has the characteristics of high automation, clear operation flow, high stability and strong applicability. Using PID liquid surface pressurized precise control, the mold filling pressure control accuracy is ±0.3 KPa; all pressurization process parameters, pressurized measurement data and temperature measurement data are recorded and saved by human-machine interface and industrial computer for use in optimization of process parameters, applying the casting process expert system in the industrial computer, the automatic setting of the casting process parameters of similar castings can be realized. The device can be widely applied to high-quality forming of large aluminum-silicon, aluminum-copper and aluminum-magnesium alloy castings, and has high application value and great industrial potential.

Embodiment 2

According to the device and method of Embodiment 1, an actual production example is given, a large-scale corrosion-resistant aluminum-magnesium alloy box member is taken as the application object, and a specific contour size thereof is 2440 mm×2070 mm×1450 mm, a wall thickness of a main body is 20.0 mm, a weight is 1642 kg, many reinforcing ribs, thick bosses and the like are provided in internal, a typical box structure, material: ZL305.

(1) Preparation before pouring: 2600 kg of the refined aluminum melt is separately transported to four holding furnaces through a quantitative delivery device for use, the holding temperature is 690±5° C., and the lift tube sprayed with a refractory coating having a thickness of 8 mm is inserted. Through the furnace body lifting system, the air inlet and outlet port of the holding furnace are sealed with the synchronous sealing device and the upper and lower lift tubes. The resin sand mold is placed on the frame platform and compressed by the pressing plate to ensure that the sand mold and the lift tube are well sealed; then the electrode contacts are connected, the working chamber is covered, and the locking ring is driven to lock the resin sand mold by four cylinder piston mechanisms.

(2) Inert gas replacement: the interconnection valve between the working chamber and the holding furnace is opened, the vacuum pump is used to perform vacuuming, the vacuuming is stopped when the vacuum degree is reduced to 45 KPa; the inert gas line solenoid valve is opened, the Ar gas station is opened, and the Ar gas is introduced into the holding furnace and the working chamber, when the pressure rises to 145 KPa, the solenoid valve is closed, achieving the replacement of inert gas, and the interconnection valve between the holding furnace and the working chamber is closed.

(3) Melt quality correction: the magnetic homogenization system is opened, and a rotating magnetic field is generated under the action of the rotation motor to make the aluminum melt moves under the action of the external rotating magnetic field, thus achieving magnetic homogenization. The magnetic field alternating frequency is 18 Hz, the rotating speed of the rotation motor is 80 r/min, and the stirring time is 15 min, after the stirring is completed, the melt is placed for 10 min, and then mold filling is performed.

(4) Multi-position synchronous liquid lifting: using the synchronous pre-mold filling, the liquid levels of the aluminum melts of the four lift tubes are lifted to the same level, and then the four holding furnaces are subjected to the multi-position synchronous liquid lifting at a pressurization rate of 1.3 KPa/s, and the electrode contact is used to catch liquid surface information. The liquid surface information is fed back to the multi-position synchronous mold filling control system through the A/D module, and the pressurization rates of the four holding furnaces are adjusted by the digital combination valve to reduce the fluctuation of the filling level, when the melt flows to the top of the mold, the mold top signal light is lighted up, and the mold filling is over.

(5) Secondary pressure solidification: during the crusting pressurization stage, the pressure is increased by 10 KPa at a pressurization rate of 0.8 KPa/s, and the crystal holding time is 30 s, so that a 5 mm outer shell forms on the surface layer of the melt; in the crystallization pressurization stage, the pressure is increased by 30 KPa at a pressurization rate of 1.5 KPa/s, so that the casting can be continuously and fully fed by the lift tube and the pouring system under the action of melt pressure. The crystallization holding time is about 1800 s, ensuring that the casting is fully solidified under pressure.

(6) Pressure relief: after the crystallization holding time is over, the holding furnace exhaust valve is opened to directly discharge the compressed air; at the same time, the working chamber exhaust valve is opened, and the Ar gas in the working chamber is discharged into the Ar gas recycling station for recycling. When the pressures of the holding furnace and the working chamber are less than 3 KPa, the locking ring is driven to open by the four cylinder piston mechanisms, the working chamber is opened, the casting mold and the lift tube are removed, and the casting equipment is cleaned.

Implementation Effect:

The tensile strength of the specified part of the casting body reaches to 360 MPa, the elongation rate is 10.0%, the pinhole degree is grade I, the porosity is grade I, the burning loss of Mg element is 0.8%, and the inclusion volume fraction is 0.1%.

Embodiment 3

According to the device and method of Embodiment 1, an actual production example is given, a large-scale high-performance aluminum-copper alloy plate-shaped member is taken as the application object, and a specific contour size thereof is 2430 mm×2160 mm×180 mm, and a wall thickness of a main body is 18.0 mm, a weight of the member is 625 kg, many reinforcing ribs, thick bosses and the like are provided in internal, a typical plate-shaped structure, material: ZL205A.

(1) Preparation before pouring: 1300 kg of the refined aluminum melt is separately sent to four holding furnaces through the quantitative delivery device for use, a holding temperature is 690±5° C., and a lift tube sprayed with a refractory coating having a thickness of 5 mm is inserted. Through a furnace body lifting system, an inlet and outlet port of the holding furnace is sealed with a synchronous sealing device and the upper and lower lift tubes, and the resin sand mold is placed on the frame platform and compressed by the pressing plate to ensure that the sand mold and the lift tube are well sealed; then the electrode contacts are connected, the working chamber is covered, and the locking ring is driven by the four cylinder piston mechanisms to lock the sand mold.

(2) Melt quality correction: the magnetic homogenization system is opened, and a rotating magnetic field is generated under the action of the rotation motor to make the aluminum melt move under the action of the external rotating magnetic field, thus achieving magnetic homogenization. The magnetic field alternating frequency is 12 Hz, the rotating speed of the rotation motor is 140 r/min, and the stirring time is 8 min, after the stirring is completed, the melt is placed for 5 min, and then mold filling is performed.

(3) Multi-position synchronous liquid lifting: using the synchronous pre-mold filling, the liquid levels of the aluminum melts of the four lift tubes are raised to the same level, and then the four holding furnaces are subjected to the multi-position synchronous liquid lifting at a pressurization rate of 1.0 KPa/s, and the electrode contact is used to catch liquid surface information. The liquid surface information is fed back to the multi-position synchronous mold filling control system through the A/D module, and the pressurization rates of the four holding furnaces are adjusted by the digital combination valve to reduce the fluctuation of the filling level, when the melt flows to the top of the mold, the mold top signal light is lighted up, and the mold filling is over.

(4) Secondary pressure solidification: during the crusting pressurization stage, the pressure is increased by 5 KPa at a pressurization rate of 0.8 KPa/s, and the crystal holding time is 18 s, so that a 5 mm outer shell forms on the surface layer of the melt; in the crystallization pressurization stage, the pressure is increased by 20 KPa at a pressurization rate of 1.2 KPa/s, so that the casting can be continuously and fully fed by the lift tube and the pouring system under the action of melt pressure. The crystallization holding time is about 1500 s, ensuring that the casting is fully solidified under pressure.

(5) Pressure relief: after the crystallization holding time is over, the holding furnace exhaust valve is opened to directly discharge the compressed air; at the same time, the working chamber exhaust valve is opened, and the Ar gas in the working chamber is discharged into the Ar gas recycling station for recycling. When the pressures of the holding furnace and the working chamber are less than 3 KPa, the locking ring is driven to open by the four cylinder piston mechanisms, the working chamber is opened, the casting mold and the lift tube are removed, and the casting equipment is cleaned.

Implementation Effect:

The tensile strength of the specified part of the casting body reaches to 520 MPa, the elongation rate is 8.0%, the pinhole degree is grade I, the porosity is grade I, the mass fraction of Cu element is (4.95±0.45)%, and the inclusion volume fraction is 0.12%.

Embodiment 4

According to the device and method of embodiment 1, an actual production example is given, a large-scale high-performance aluminum-silicon alloy cabin member is taken as the application object, when pouring, one mold is used for simultaneously producing four castings, so as to improve production efficiency and save production costs. The specific contour size is 463 mm×590 mm×900 mm, the main body wall thickness is 6.0 mm, the weight 82 kg, and the outer shape contains four circular windows of Φ40 mm, two direction windows of 250 mm×300 mm, typical cabin structure, material: ZL114A.

(1) Preparation before pouring: 980 kg of the refined aluminum melt is separately sent to four holding furnaces through the quantitative delivery device for use, a holding temperature is 690±5° C., and a lift tube sprayed with a refractory coating having a thickness of 4 mm is inserted. Through a furnace body lifting system, an inlet and outlet port of the holding furnace is sealed with a synchronous sealing device and the upper and lower lift tubes, and the resin sand mold is placed on the frame platform and compressed by the pressing plate to ensure that the sand mold and the lift tube are well sealed; then the electrode contacts are connected, the working chamber is covered, and the locking ring is driven by the four cylinder piston mechanisms to lock the sand mold.

(2) Multi-position synchronous liquid lifting: using the synchronous pre-mold filling, the liquid levels of the aluminum melts of the four lift tubes are raised to the same level, and then the four holding furnaces are subjected to the multi-position synchronous liquid lifting at a pressurization rate of 1.2 KPa/s, and the electrode contact is used to catch liquid surface information. The liquid surface information is fed back to the multi-position synchronous mold filling control system through the A/D module, and the pressurization rates of the four holding furnaces are adjusted by the digital combination valve to reduce the fluctuation of the filling level, when the melt flows to the top of the mold, the mold top signal light is lighted up, and the mold filling is over.

(3) Secondary pressure solidification: during the crusting pressurization stage, the pressure is increased by 8 KPa at a pressurization rate of 0.9 KPa/s, and the crystal holding time is 25 s, so that a 4 mm outer shell is formed on the surface layer of the melt; in the crystallization pressurization stage, the pressure is increased by 25 KPa at a pressurization rate of 1.4 KPa/s, so that the casting can be continuously and fully red by the lift tube and the pouring system under the action of melt pressure. The crystallization holding time is about 1600 s, ensuring that the casting is fully solidified under pressure.

(4) Pressure relief: after the crystallization holding time is over, the holding furnace exhaust valve is opened to directly discharge the compressed air; at the same time, the working chamber exhaust valve is opened, and the Ar gas in the working chamber is discharged into the Ar gas recycling station for recycling. When the pressures of the holding furnace and the working chamber are less than 3 KPa, the locking ring is driven to open by the four cylinder piston mechanisms, the working chamber is opened, the casting mold and the lift tube are removed, and the casting equipment is cleaned.

Implementation Effect:

The tensile strength of the specified part of the casting body reaches to 350 MPa, the elongation rate is 6.0%, the pinhole degree is grade I, the porosity is grade I, and the inclusion volume fraction is 0.08%.

What is claimed is:

1. A multi-position parallel pressurized casting device for large aluminum alloy castings, comprising a platform; wherein a top surface of the platform is a working surface, and a bottom surface of the platform is provided with holding furnaces; a number of the holding furnaces is two or more, and each holding furnace of the two or more holding furnaces is connected to a liquid filling port corresponding to the working surface through a lift device, and the each holding furnace achieves an independent liquid level pressurized control or a synchronization liquid level pressurized control in any combination by a lift control system; and a cover body is also provided on the working surface, the cover body and the working surface form a sealed working chamber, and an vacuum-pumping system and an inert gas replacement system for the working chamber and/or the each holding furnace are further provided, wherein the lift device comprises a lift tube upper section disposed on the bottom surface of the platform and connected to a liquid lifting port, and a lift tube lower section disposed at the liquid lifting port of the each holding furnace;

the lift tube upper section comprises an upper lift tube disposed on an inner side, an thermal insulation layer wrapped outside the upper lift tube, and an outer casing wrapped around the thermal insulation layer; a top surface of the outer casing is locked to a pressure plate by a screw, and the pressure plate is fixedly connected to the platform, and a bottom surface of the outer casing is provided with a locking plate; the upper lift tube, the thermal insulation layer and the outer casing are fixed by the locking plate; a pressing plate is provided with a first opening, and the upper lift tube is connected to the liquid filling port through the first opening, the locking plate is provided with a second opening, the lift tube is connected to the second opening, and a lower surface under the second opening is provided with a groove expanding outwardly; the thermal insulation layer is provided with a resistance wire and a thermal insulation sleeve, the resistance wire is externally connected to a heating device;

the lift tube lower section comprises a lower lift tube extending into the each holding furnace, and the lower lift tube extends from the liquid lifting port of the each holding furnace for fixing; an outer ring of the lower lift tube is provided with a sealing ring; and the sealing ring is fixed on a top surface of the liquid lifting port.

2. The multi-position parallel pressurized casting device for large aluminum alloy castings according to claim 1, wherein an vacuum-pumping tube is disposed on the each holding furnace and/or the working chamber; the vacuum-pumping tube is connected to a vacuum source; an inert gas replacement pipe is disposed on the each holding furnace and/or the working chamber; and the inert gas replacement pipe is connected to an inert gas source, and an exhaust passage is further disposed on the working chamber.

3. The multi-position parallel pressurized casting device for large aluminum alloy castings according to claim 2, wherein the number of the holding furnaces is four, a furnace body walking mechanism is disposed at a bottom of the each holding furnace of the four holding furnaces, and a furnace body lifting mechanism is further disposed between the furnace body walking mechanism and the each holding furnace; the furnace body walking mechanism comprises sliding rails laid on a ground and passing through the platform, and a walking wheel disposed on a bottom surface of a furnace body; the sliding rails are two sets arranged in parallel, and two holding furnaces of the four holding furnaces are arranged on any one of the sliding rails, the two holding furnaces on a same sliding rail move toward and away from each other; the furnace body lifting mechanism is a screw lifting mechanism; and the furnace body walking mechanism and the furnace body lifting mechanism are both hydraulically controlled.

4. The multi-position parallel pressurized casting device for large aluminum alloy castings according to claim 2, wherein the each holding furnace comprises a furnace body and a graphite crucible installed in the furnace body; the furnace body is provided with a furnace lid, the furnace lid is provided with an air inlet and outlet device connected to the graphite crucible; a heat preservation device is further disposed outside the furnace body; a liquid leakage guide outlet is disposed at a bottom of the furnace body, and a stirring device is disposed at the bottom of the furnace body;

the air inlet and outlet device comprises an air inlet and outlet port connected to the graphite crucible, and an air inlet and outlet passage corresponding to the air inlet and outlet port; a synchronous sealing device is disposed between the air inlet and outlet passage and the air inlet and outlet port; the synchronous sealing device comprises a guide sleeve fixedly connected to the air inlet and outlet passage, and a hollow guide rod; a first end of the hollow guide rod is inserted into the guide sleeve, and a second end of the hollow guide rod is provided with a boss protruding outwardly, and a middle portion of the guide rod is provided with an elastic mechanism; the elastic mechanism comprises a fixing block sleeved on the hollow guide rod, and a disc spring assembly is disposed between the fixing block and the boss; a first end of the disc spring assembly is connected to the fixing block, and a second end of the disc spring assembly is connected to the boss; and the synchronous sealing device further comprises a sealing ring disposed at the air inlet and outlet port;

the heat preservation device comprises a resistance band fixedly disposed on an inner side wall of the furnace body, and the resistance band is connected to a binding post disposed on an outer side wall of the furnace body by a wire, and the resistance band is heated by energizing the binding post; and a temperature detecting device is respectively disposed in the furnace body and the graphite crucible;

a liquid leakage guide port is disposed at a lower portion of the furnace body; a part from the liquid leakage guide port to an inner bottom wall of the furnace body is configured as an inclined surface; and the bottom of the furnace body is a flat surface, and a magnetic homogenization device is disposed at the bottom of the furnace body.

5. The multi-position parallel pressurized casting device for large aluminum alloy castings according to claim 2, wherein the platform is disposed on a frame; the frame comprises a column for supporting, the cover body is connected to the platform by a locking device, the locking device comprises a locking flange disposed on the platform; an outer edge of the locking flange is provided with a locking tooth A, an outer edge of a lower portion of the cover body is provided with a locking tooth B corresponding to the locking tooth A; a locking ring is disposed outside the locking tooth A and the locking tooth B, the locking ring is provided with a U-shaped locking ring facing toward the locking tooth A and the locking tooth B, the U-shaped locking ring locks and fixes the locking tooth A and the locking tooth B; and a ball mechanism is provided between a bottom of the locking ring and the bottom of the platform, a wedge mechanism is respectively disposed between an inner top wall of the U-shaped locking ring and the locking tooth A, and between the inner bottom wall of the U-shaped locking ring and the locking ring B in a circumferential direction; and a cylinder piston mechanism is connected to an outer wall of the locking ring, a cylinder end of the cylinder piston mechanism is fixed on the platform, and a piston end of the cylinder piston mechanism is fixedly connected to the locking ring.

6. The multi-position parallel pressurized casting device for large aluminum alloy castings according to claim 1, wherein the number of the holding furnaces is four, a furnace body walking mechanism is disposed at a bottom of the each holding furnace of the four holding furnaces, and a furnace body lifting mechanism is further disposed between the furnace body walking mechanism and the each holding furnace; the furnace body walking mechanism comprises sliding rails laid on a ground and passing through the platform, and a walking wheel disposed on a bottom surface of a furnace body; the sliding rails are two sets arranged in parallel, and two holding furnaces of the four holding furnaces are arranged on any one of the sliding rails, the two holding furnaces on a same sliding rail move toward and away from each other; the furnace body lifting mechanism is a screw lifting mechanism; and the furnace body walking mechanism and the furnace body lifting mechanism are both hydraulically controlled.

7. The multi-position parallel pressurized casting device for large aluminum alloy castings according to claim 6, wherein the each holding furnace comprises the furnace body and a graphite crucible installed in the furnace body; the furnace body is provided with a furnace lid, the furnace lid is provided with an air inlet and outlet device connected to the graphite crucible; a heat preservation device is further disposed outside the furnace body; a liquid leakage guide outlet is disposed at a bottom of the furnace body, and a stirring device is disposed at the bottom of the furnace body;

the air inlet and outlet device comprises an air inlet and outlet port connected to the graphite crucible, and an air inlet and outlet passage corresponding to the air inlet and outlet port; a synchronous sealing device is disposed between the air inlet and outlet passage and the air inlet and outlet port; the synchronous sealing device comprises a guide sleeve fixedly connected to the air inlet and outlet passage, and a hollow guide rod; a first end of the hollow guide rod is inserted into the guide sleeve, and a second end of the hollow guide rod is provided with a boss protruding outwardly, and a middle portion of the guide rod is provided with an elastic mechanism; the elastic mechanism comprises a fixing block sleeved on the hollow guide rod, and a disc spring assembly is disposed between the fixing block and the boss; a first end of the disc spring assembly is connected to the fixing block, and a second end of the disc spring assembly is connected to the boss; and the synchronous sealing device further comprises a sealing ring disposed at the air inlet and outlet port;

the heat preservation device comprises a resistance band fixedly disposed on an inner side wall of the furnace body, and the resistance band is connected to a binding post disposed on an outer side wall of the furnace body by a wire, and the resistance band is heated by energizing the binding post; and a temperature detecting device is respectively disposed in the furnace body and the graphite crucible;

a liquid leakage guide port is disposed at a lower portion of the furnace body; a part from the liquid leakage guide port to an inner bottom wall of the furnace body is configured as an inclined surface; and the bottom of the furnace body is a flat surface, and a magnetic homogenization device is disposed at the bottom of the furnace body.

8. The multi-position parallel pressurized casting device for large aluminum alloy castings according to claim 6, wherein the platform is disposed on a frame; the frame comprises a column for supporting, the cover body is connected to the platform by a locking device, the locking device comprises a locking flange disposed on the platform; an outer edge of the locking flange is provided with a locking tooth A, an outer edge of a lower portion of the cover body is provided with a locking tooth B corresponding to the locking tooth A; a locking ring is disposed outside the locking tooth A and the locking tooth B, the locking ring is provided with a U-shaped locking ring facing toward the locking tooth A and the locking tooth B, the U-shaped locking ring locks and fixes the locking tooth A and the locking tooth B; and a ball mechanism is provided between a bottom of the locking ring and the bottom of the platform, a wedge mechanism is respectively disposed between an inner top wall of the U-shaped locking ring and the locking tooth A, and between the inner bottom wall of the U-shaped locking ring and the locking ring B in a circumferential direction; and a cylinder piston mechanism is connected to an outer wall of the locking ring, a cylinder end of the cylinder piston mechanism is fixed on the platform, and a piston end of the cylinder piston mechanism is fixedly connected to the locking ring.

9. The multi-position parallel pressurized casting device for large aluminum alloy castings according to claim 1, wherein the each holding furnace comprises a furnace body and a graphite crucible installed in the furnace body; the furnace body is provided with a furnace lid, the furnace lid is provided with an air inlet and outlet device connected to the graphite crucible; a heat preservation device is further disposed outside the furnace body; a liquid leakage guide outlet is disposed at a bottom of the furnace body, and a stirring device is disposed at the bottom of the furnace body;

the air inlet and outlet device comprises an air inlet and outlet port connected to the graphite crucible, and an air inlet and outlet passage corresponding to the air inlet and outlet port; a synchronous sealing device is disposed between the air inlet and outlet passage and the air inlet and outlet port; the synchronous sealing device comprises a guide sleeve fixedly connected to the air inlet and outlet passage, and a hollow guide rod; a first end of the hollow guide rod is inserted into the guide sleeve, and a second end of the hollow guide rod is provided with a boss protruding outwardly, and a middle portion of the guide rod is provided with an elastic mechanism; the elastic mechanism comprises a fixing block sleeved on the hollow guide rod, and a disc spring assembly is disposed between the fixing block and the boss; a first end of the disc spring assembly is connected to the fixing block, and a second end of the disc spring assembly is connected to the boss; and the synchronous sealing device further comprises a sealing ring disposed at the air inlet and outlet port;

the heat preservation device comprises a resistance band fixedly disposed on an inner side wall of the furnace body, and the resistance band is connected to a binding post disposed on an outer side wall of the furnace body by a wire, and the resistance band is heated by energizing the binding post; and a temperature detecting device is respectively disposed in the furnace body and the graphite crucible;

a liquid leakage guide port is disposed at a lower portion of the furnace body; a part from the liquid leakage guide port to an inner bottom wall of the furnace body is configured as an inclined surface; and the bottom of the furnace body is a flat surface, and a magnetic homogenization device is disposed at the bottom of the furnace body.

10. The multi-position parallel pressurized casting device for large aluminum alloy castings according to claim 9, wherein the platform is disposed on a frame; the frame comprises a column for supporting, the cover body is connected to the platform by a locking device, the locking device comprises a locking flange disposed on the platform; an outer edge of the locking flange is provided with a locking tooth A, an outer edge of a lower portion of the cover body is provided with a locking tooth B corresponding to the locking tooth A; a locking ring is disposed outside the locking tooth A and the locking tooth B, the locking ring is provided with a U-shaped locking ring facing toward the locking tooth A and the locking tooth B, the U-shaped locking ring locks and fixes the locking tooth A and the locking tooth B; and a ball mechanism is provided between a bottom of the locking ring and the bottom of the platform, a wedge mechanism is respectively disposed between an inner top wall of the U-shaped locking ring and the locking tooth A, and between the inner bottom wall of the U-shaped locking ring and the locking ring B in a circumferential direction; and a cylinder piston mechanism is connected to an outer wall of the locking ring, a cylinder end of the cylinder piston mechanism is fixed on the platform, and a piston end of the cylinder piston mechanism is fixedly connected to the locking ring.

11. The multi-position parallel pressurized casting device for large aluminum alloy castings according to claim 1, wherein the platform is disposed on a frame; the frame comprises a column for supporting, the cover body is connected to the platform by a locking device, the locking device comprises a locking flange disposed on the platform; an outer edge of the locking flange is provided with a locking tooth A, an outer edge of a lower portion of the cover body is provided with a locking tooth B corresponding to the locking tooth A; a locking ring is disposed outside the locking tooth A and the locking tooth B, the locking ring is provided with a U-shaped locking ring facing toward the locking tooth A and the locking tooth B, the U-shaped locking ring locks and fixes the locking tooth A and the locking tooth B; and a ball mechanism is provided between a bottom of the locking ring and the bottom of the platform, a wedge mechanism is respectively disposed between an inner top wall of the U-shaped locking ring and the locking tooth A, and between the inner bottom wall of the U-shaped locking ring and the locking ring B in a circumferential direction; and a cylinder piston mechanism is connected to an outer wall of the locking ring, a cylinder end of the cylinder piston mechanism is fixed on the platform, and a piston end of the cylinder piston mechanism is fixedly connected to the locking ring.

12. The multi-position parallel pressurized casting device for large aluminum alloy castings according to claim 1, wherein the lift control system comprises a compressed gas source, the compressed gas source is provided with branches connected to four holding furnaces, and each of the branches is provided with a first solenoid valve; an interconnection valve is provided between each holding furnace of the four holding furnaces and the working chamber; a pressure control module is disposed between the first solenoid valve and the compressed gas source; a pressure transmitter is further disposed between the pressure control module and the each holding furnace, and a pressure signal of the each holding furnace is fed back through the pressure transmitter, the pressure control module receives the pressure signal and performs a pressure control and adjustment through a A/D module of a programmable logic controller (PLC); the PLC is further connected to a human-machine interface industrial computer; a second solenoid valve and a manual valve connected in series are further disposed on the compressed gas source.

13. The multi-position parallel pressurized casting device for large aluminum alloy castings according to claim 1, wherein the vacuum-pumping system comprises a vacuum source, the vacuum source is provided with branches connected to four holding furnaces and the working chamber, and each of the branches is provided with a first solenoid valve, a first and second pressure control module is further disposed on each holding furnace of the four holding furnaces, a first and second pressure transmitter are further disposed between the first and second pressure control module and the each holding furnace, a one-way throttle valve is further disposed on the working chamber, and the working chamber is also connected to an exhaust system, the exhaust system is provided with a second solenoid valve, and the working chamber is also connected to the first and second pressure transmitter, and a manual valve and a third solenoid valve are sequentially connected in series on an output of the vacuum source.

14. The multi-position parallel pressurized casting device for large aluminum alloy castings according to claim 1, wherein the inert gas replacement system comprises an inert gas source, and the inert gas source is provided with branches connected to the holding furnaces and the working chamber, and each of the branches is provided with a first solenoid valve; a first and second pressure control module is further disposed on the each holding furnace, a first and second pressure transmitter are further disposed between the first and second pressure control module and the each holding furnace, a one-way throttle valve is further disposed on the working chamber, and the working chamber is also connected to an exhaust system, the exhaust system is provided with a second solenoid valve, and the working chamber is also connected to the first and second pressure transmitter, and a manual valve and a third solenoid valve are sequentially connected in series on an output of the vacuum source.

15. The multi-position parallel pressurized casting device for large aluminum alloy castings according to claim 1, wherein the each holding furnace comprises a furnace body and a graphite crucible installed in the furnace body; the furnace body is provided with a furnace lid, the furnace lid is provided with an air inlet and outlet device connected to the graphite crucible; a heat preservation device is further disposed outside the furnace body; a liquid leakage guide outlet is disposed at a bottom of the furnace body, and a stirring device is disposed at the bottom of the furnace body;

the air inlet and outlet device comprises an air inlet and outlet port connected to the graphite crucible, and an air inlet and outlet passage corresponding to the air inlet and outlet port; a synchronous sealing device is disposed between the air inlet and outlet passage and the air inlet and outlet port; the synchronous sealing device comprises a guide sleeve fixedly connected to the air inlet and outlet passage, and a hollow guide rod; a first end of the hollow guide rod is inserted into the guide sleeve, and a second end of the hollow guide rod is provided with a boss protruding outwardly, and a middle portion of the guide rod is provided with an elastic mechanism; the elastic mechanism comprises a fixing block sleeved on the hollow guide rod, and a disc spring assembly is disposed between the fixing block and the boss; a first end of the disc spring assembly is connected to the fixing block, and a second end of the disc spring assembly is connected to the boss; and the synchronous sealing device further comprises a sealing ring disposed at the air inlet and outlet port;

the heat preservation device comprises a resistance band fixedly disposed on an inner side wall of the furnace body, and the resistance band is connected to a binding post disposed on an outer side wall of the furnace body by a wire, and the resistance band is heated by energizing the binding post; and a temperature detecting device is respectively disposed in the furnace body and the graphite crucible;

a liquid leakage guide port is disposed at a lower portion of the furnace body; a part from the liquid leakage guide port to an inner bottom wall of the furnace body is configured as an inclined surface; and the bottom of the furnace body is a flat surface, and a magnetic homogenization device is disposed at the bottom of the furnace body.

16. The multi-position parallel pressurized casting device for large aluminum alloy castings according to claim 1, wherein the platform is disposed on a frame; the frame comprises a column for supporting, the cover body is connected to the platform by a locking device, the locking device comprises a locking flange disposed on the platform; an outer edge of the locking flange is provided with a locking tooth A, an outer edge of a lower portion of the cover body is provided with a locking tooth B corresponding to the locking tooth A; a locking ring is disposed outside the locking tooth A and the locking tooth B, the locking ring is provided with a U-shaped locking ring facing toward the locking tooth A and the locking tooth B, the U-shaped locking ring locks and fixes the locking tooth A and the locking tooth B; and a ball mechanism is provided between a bottom of the locking ring and the bottom of the platform, a wedge mechanism is respectively disposed between an inner top wall of the U-shaped locking ring and the locking tooth A, and between the inner bottom wall of the U-shaped locking ring and the locking ring B in a circumferential direction; and a cylinder piston mechanism is connected to an outer wall of the locking ring, a cylinder end of the cylinder piston mechanism is fixed on the platform, and a piston end of the cylinder piston mechanism is fixedly connected to the locking ring.

17. A multi-position parallel pressurized casting method for large aluminum alloy castings, comprising a casting device, wherein the casting device comprises a platform; a top surface of the platform is a working surface, and a bottom surface of the platform is provided with holding furnaces; a number of the holding furnaces is two or more, and each holding furnace of the two or more holding furnaces is connected to a liquid filling port corresponding to the working surface through a lift device, and the each holding furnace achieves an independent liquid level pressurized control or a synchronization liquid level pressurized control in any combination by a lift control system; and a cover body is also provided on the working surface, the cover body and the working surface form a sealed working chamber, and an vacuum-pumping system and an inert gas replacement system for the working chamber and/or the each holding furnace are further provided; wherein the multi-position parallel pressurized casting method for large aluminum alloy castings comprises the following steps:

1) preparation before pouring: transferring a refined aluminum melt to four holding furnaces through a quantitative delivery device, inserting a lift tube lower portion into a liquid lifting port of the each holding furnace, and locking a lift tube lower section with the each holding furnace with a bolt; moving the each holding furnace to a lower part of a frame platform through a furnace body walking mechanism, then, through a furnace body lifting mechanism, completing connections and sealings between an air inlet and outlet port of the each holding furnace and an inlet and outlet passage mechanism, and between a lift tube upper section and the lift tube lower section; placing a resin sand mold on the frame platform and compressing the resin sand mold with a pressure plate, using a sealing gasket to ensure that the resin sand mold and the lift tube are sealed; connecting electrode contacts, covering the working chamber, and driving a locking ring to lock the resin sand mold by four cylinder piston mechanisms;

2) synchronous negative pressure and inert gas replacement: opening an interconnection valve between the each holding furnace and the working chamber, performing a vacuuming and an inert gas replacement in the working chamber, firstly, opening a solenoid valve of a vacuum line, using a vacuum pump to perform the vacuuming, when a vacuum degree is reduced to 40-60 KPa, closing the solenoid valve to stop the vacuuming; opening a solenoid valve of an inert gas line, opening a Ar gas station, filing the each holding furnace and the working chamber with Ar gas, when a pressure rises to 120-150 KPa, closing the solenoid valve of the inert gas line to realize the inert gas replacement; finally, closing the interconnection valve between the each holding furnace and the working chamber;

3) melt quality correction: opening a magnetic homogenization device, generating a constant magnetic field in an iron core, wherein the iron core is placed in a preset structure, magnetic lines are scattered in a particular shape in space, under an action of a rotation motor, generating a rotating magnetic field to make the refined aluminum melt move under an action of an applied rotating magnetic field, achieving a purpose of a magnetic homogenization;

4) synchronous pre-mold filling: calculating pre-mold filling pressures of four lift tube devices according to a theoretical formula $P=\rho hg$ firstly, and then carrying out the synchronous pre-mold filling of the four lift tube devices, firstly, opening a pressure control module of a first holding furnace, raising a liquid level of the lift tube to a position of an electrode contact mark, closing the pressure control module of the first holding furnace by a feedback signal of an A/D module; then opening pressure control modules of a second holding furnace, a third holding furnace, and a fourth holding furnace in sequence for the synchronous pre-mold filling; finally, raising liquid levels of aluminum melts of the four lift tube devices to a same level;

5) multi-position synchronous liquid lifting: according to a initially set liquid pressure pressurization process curve, opening the pressure control module for an initial pressurization, using the electrode contacts to capture liquid surface information, feeding back the liquid surface information to a multi-position synchronous mold filling control system through the A/D module, and adjusting pressurization rates of the four holding furnaces and ensuring that the castings are simultaneously lifted through the pressure control module, when the aluminum melt flows to a top of the resin sand mold, a top signal light is lighted up, and a mold filling is completed;

6) secondary pressure solidification: during a crusting pressurization stage, increasing a pressure of the aluminum melt in the each holding furnace, and a crystal holding time is 15-30 s, so that a shell of 3-5 mm is formed in a surface layer of the aluminum melt; during a crystallization pressurization stage, according to structural characteristics of the castings, the castings are continuously and fully fed through the lift tube device and a pouring system under an action of a melt pressure; a crystallization holding time is about 1500-1800 s, ensuring that the castings are fully solidified under pressure; and 7) pressure relief: after a crystallization retention time is over, closing the pressure control modules of the first holding furnace, the second holding furnace, the third holding furnace and the fourth holding furnace, opening a holding furnace exhaust valve, and directly discharging compressed air; opening a working chamber exhaust valve to discharge the Ar gas in the working chamber into a Ar gas recovery station for a recycling treatment; when pressures of the each holding furnace and the working chamber are less than 3 KPa, the locking ring is driven to open by the four cylinder piston mechanisms, the working chamber and a cast mold are removed, and the each holding furnace and the lift tube are lowered to a bottom through a furnace body lifting system; and then exiting a working area through a horizontal moving mechanism to perform a cleaning treatment.

* * * * *